US012239192B2

(12) United States Patent
Pounder, III

(10) Patent No.: US 12,239,192 B2
(45) Date of Patent: Mar. 4, 2025

(54) JEWELRY

(71) Applicant: Cecil James Pounder, III, Spokane, WA (US)

(72) Inventor: Cecil James Pounder, III, Spokane, WA (US)

( * ) Notice: Subject to any disclaimer, the term of this patent is extended or adjusted under 35 U.S.C. 154(b) by 0 days.

(21) Appl. No.: 18/107,501

(22) Filed: Feb. 9, 2023

(65) Prior Publication Data

US 2023/0255328 A1 Aug. 17, 2023

Related U.S. Application Data

(62) Division of application No. 16/557,595, filed on Aug. 30, 2019, now abandoned, which is a division of application No. 16/168,773, filed on Oct. 23, 2018, now abandoned.

(51) Int. Cl.
*A44C 9/00* (2006.01)

(52) U.S. Cl.
CPC ..... *A44C 9/0046* (2013.01)

(58) Field of Classification Search
CPC ..... A44C 9/00; A44C 9/0007; A44C 9/0015; A44C 9/003; A44B 11/258
See application file for complete search history.

(56) References Cited

U.S. PATENT DOCUMENTS 119,540 A 10/1871 Sprague
135,712 A 2/1873 Jenks
203,792 A * 5/1878 Street ..... A44C 9/02 63/11
367,449 A * 8/1887 Scott ..... A44C 17/0208 63/29.1
861,638 A * 7/1907 Condory ..... A44C 9/02 63/11
1,296,435 A * 3/1919 Schmidt ..... A44C 9/02 63/15.5
1,409,138 A 3/1922 Fontana
1,858,861 A * 5/1932 Levin ..... A44C 9/02 63/15.6
2,182,876 A 12/1939 Moldenhauer
2,571,674 A * 10/1951 Braunstein ..... A44C 9/0023 292/147
2,579,856 A * 12/1951 Pollard ..... A44C 9/02 63/15.6
2,653,402 A * 9/1953 Bonagura ..... G09F 7/16 63/3
2,706,542 A * 4/1955 Schaeffer ..... A44C 9/00 403/14

(Continued)

FOREIGN PATENT DOCUMENTS

FR 3019446 10/2015
GB 2091336 7/1982
WO WO 99/45812 9/1999

*Primary Examiner* — Emily M Morgan
(74) *Attorney, Agent, or Firm* — Wells St. John P.S.

(57) ABSTRACT

This disclosure includes jewelry that has an arcuate first body with opposite first and second ends, each end defining an opening. An arcuate second body has an end with a hinge element in the opening of the first end of the first body to provide pivot capability between the first and second bodies. An arcuate third body has an end with a hinge element in the opening of the second end of the first body to provide pivot capability between the first and third bodies.

15 Claims, 35 Drawing Sheets

(56) References Cited

U.S. PATENT DOCUMENTS 2,771,753 A 11/1956 Sallan
3,221,514 A 12/1965 Newman
3,238,741 A * 3/1966 Johnson ..... A44C 9/02 D11/86
3,423,956 A 1/1969 Manne
3,465,543 A * 9/1969 Baker ..... A44C 9/02 24/598.2
3,609,993 A 10/1971 Graf
3,683,642 A * 8/1972 Lutrario ..... A44C 9/02 63/15.45
3,736,770 A 6/1973 Kelrick
3,890,801 A 6/1975 Newman
4,424,611 A 1/1984 Mori
4,592,211 A 6/1986 Ross
4,790,148 A 12/1988 Faini
4,991,409 A * 2/1991 Creates ..... A44C 9/0046 63/15.7
5,136,858 A 8/1992 Bruner
D331,724 S 12/1992 Klein
5,186,023 A 2/1993 Goldberg
D343,590 S 1/1994 Dubs
5,359,866 A * 11/1994 Boddy ..... F16L 21/06 24/270
5,412,956 A 5/1995 Levy
5,544,511 A 8/1996 Cavaleri
D379,329 S 5/1997 Pandel
5,669,241 A * 9/1997 Kohl ..... A44C 9/0015 63/15.1
5,682,768 A 11/1997 Nissenbaum
5,727,399 A 3/1998 Bergagnini
5,806,344 A * 9/1998 Bonchek ..... A44C 9/0023 63/15.1
5,943,882 A * 8/1999 Erb ..... A44C 9/02 63/15.5
6,032,485 A 3/2000 Steinberg
6,125,657 A 10/2000 Esposito
6,311,373 B1 11/2001 Hashimoto
6,560,993 B1 * 5/2003 Bosque ..... A44C 5/0092 63/3
D495,616 S 9/2004 Fountoulakis
6,928,734 B1 8/2005 West
D515,450 S 2/2006 Schiesl-Griesinger
7,107,789 B1 * 9/2006 Bruner ..... A44C 9/0046 63/3.1
7,347,066 B1 3/2008 Feuer
D600,155 S 9/2009 Canova
7,644,900 B2 1/2010 Yap et al.
8,961,340 B2 * 2/2015 Boatwright ..... A63B 60/42 473/568
D779,997 S 2/2017 King
D832,130 S 10/2018 Bostic
D862,278 S 10/2019 Joshi
D866,385 S 11/2019 Joshi
D889,308 S 7/2020 Yep
D909,230 S 2/2021 Pounder
2002/0178749 A1 12/2002 Katano
2003/0177787 A1 9/2003 Kuo
2004/0172968 A1 9/2004 Hug
2006/0048357 A1 * 3/2006 Alulis ..... A44C 9/0046 29/896.412
2008/0295287 A1 12/2008 Hetherington
2013/0305779 A1 * 11/2013 Gallagher ..... A44C 9/0038 63/3.1
2014/0083135 A1 3/2014 Martinez
2015/0089976 A1 4/2015 Alulis et al.
2016/0270490 A1 * 9/2016 Huynh ..... A44C 9/0046
2016/0316868 A1 * 11/2016 Parikh ..... A44C 9/00
2019/0014869 A1 1/2019 Yep
2019/0045890 A1 2/2019 Garcia et al.
2019/0053586 A1 * 2/2019 Potash ..... A41D 27/08
2019/0082801 A1 * 3/2019 Burton ..... A44C 17/0216
2020/0121039 A1 4/2020 Pounder

* cited by examiner

JEWELRY

RELATED PATENT DATA

This patent resulted from a divisional of U.S. patent application Ser. No. 16/557,595, filed Aug. 30, 2019, which resulted from a divisional of U.S. patent application Ser. No. 16/168,773, filed Oct. 23, 2018, the disclosures of which are incorporated herein by reference.

TECHNICAL FIELD

This invention relates to jewelry and methods for using jewelry.

BACKGROUND OF THE INVENTION

Jewelry has been worn for millennium as personal adornment and expression. For example, rings and bracelets are routinely worn on various combinations of fingers, arms, legs, toes and even necks. Primary structural designs (configurations) for this type of jewelry are circular bands of material that are positioned at desired locations of the body. Placement of the jewelry at the desired location of the body routinely occurs by sliding the jewelry over portions of the body until a desired location or position is reached. To reach these desired locations of the body, the dimensions of the jewelry (particularly the diameter of the inner periphery or surface) must compensate for the greatest dimensions of the body that the jewelry will encounter to reach the desired location during the sliding action. Accordingly, the jewelry is routinely sized (dimensioned) larger than needed for the desired location of the body that the jewelry will ultimately rest.

As an example, a ring for a finger is routinely slid over a knuckle or joint of the finger that has a larger dimension than the desired location of the finger that the ring will ultimately rest. With the diameter of the ring having a larger dimension than needed for a desired location, the ring will always have the possibility of sliding off the finger potentially being lost and never to be found. Consequently, there is a need for improved designs (configurations) and methods of placement to securely maintain jewelry at desired locations of the body.

While the invention was motivated for addressing the difficulty of positioning jewelry at the desired location of the body, it is in no way so limited. The invention is only limited by the accompanying claims as literally worded, without interpretative or other limiting reference to the specification, and in accordance with the doctrine of equivalents.

Other aspects and implementations are contemplated.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

This application incorporates by reference the entire disclosure of U.S. Design Patent Application filed on Oct. 23, 2018, application Ser. No. 29/667,653.

Figure 7:
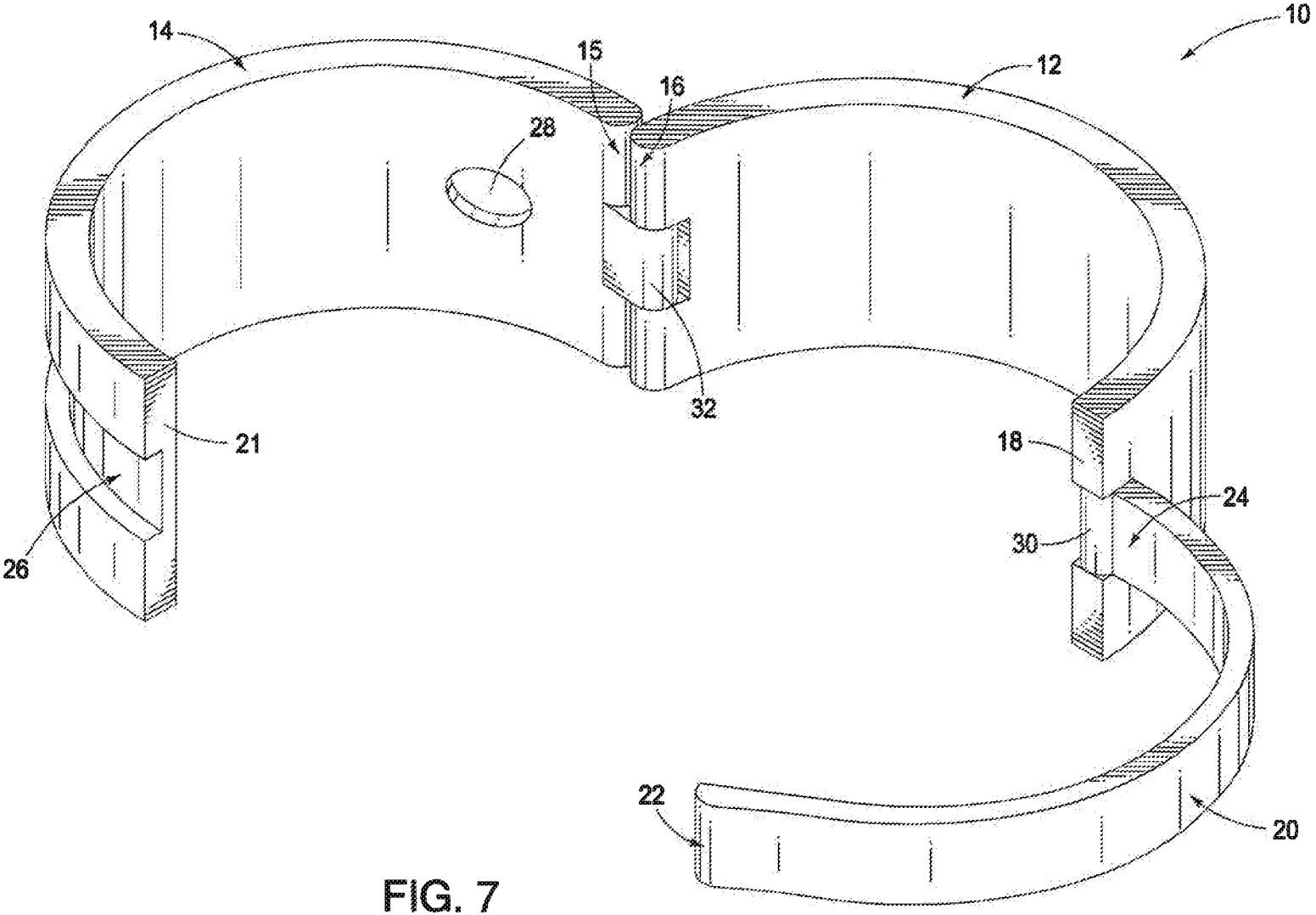
FIG. 7 is a perspective view of the FIG. 1 jewelry in an open orientation illustrating mostly inner peripheries.
Figure 8:
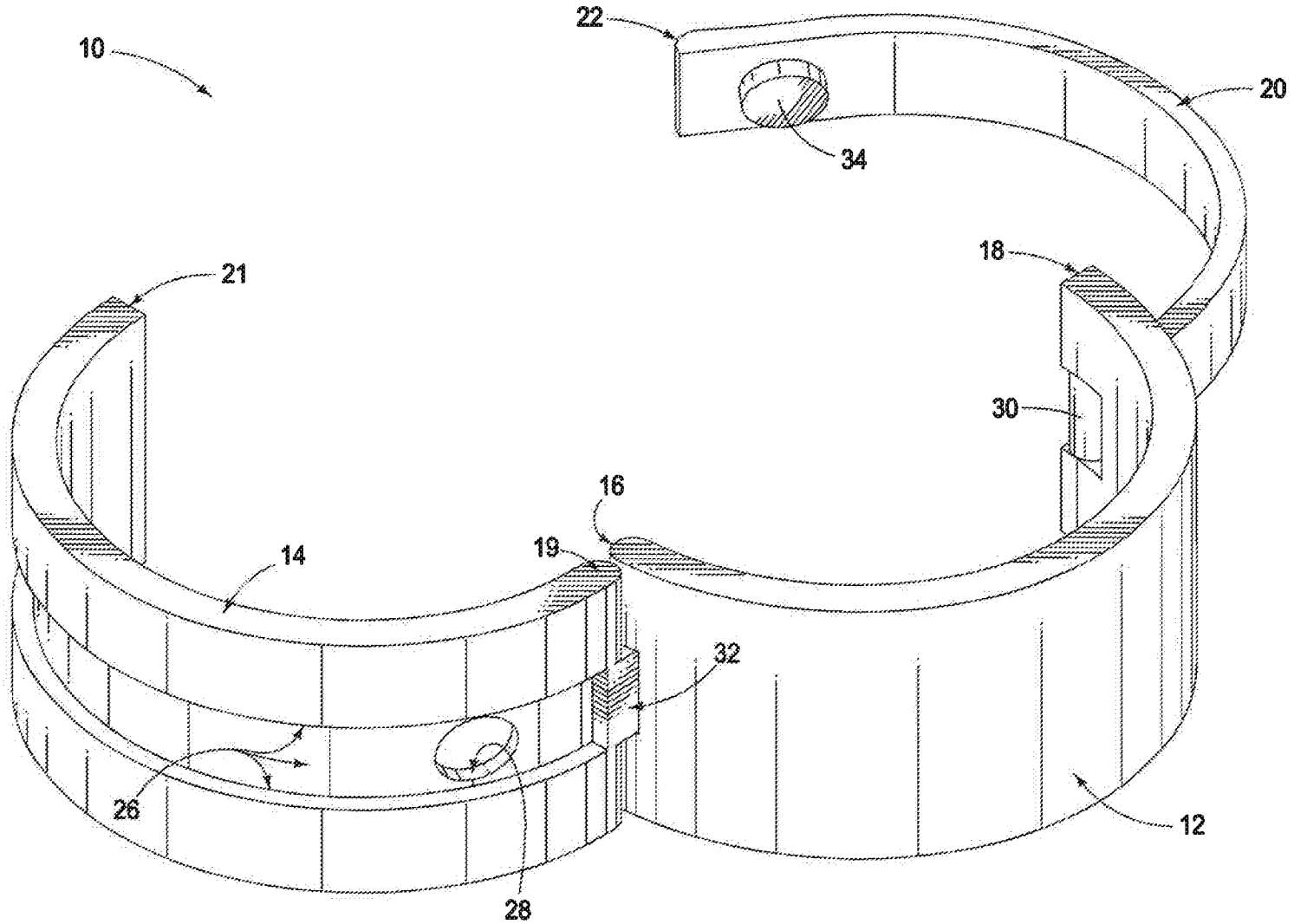
FIG. 8 is a perspective view of the FIG. 1 jewelry in the open orientation illustrating mostly outer peripheries.
Figure 9:
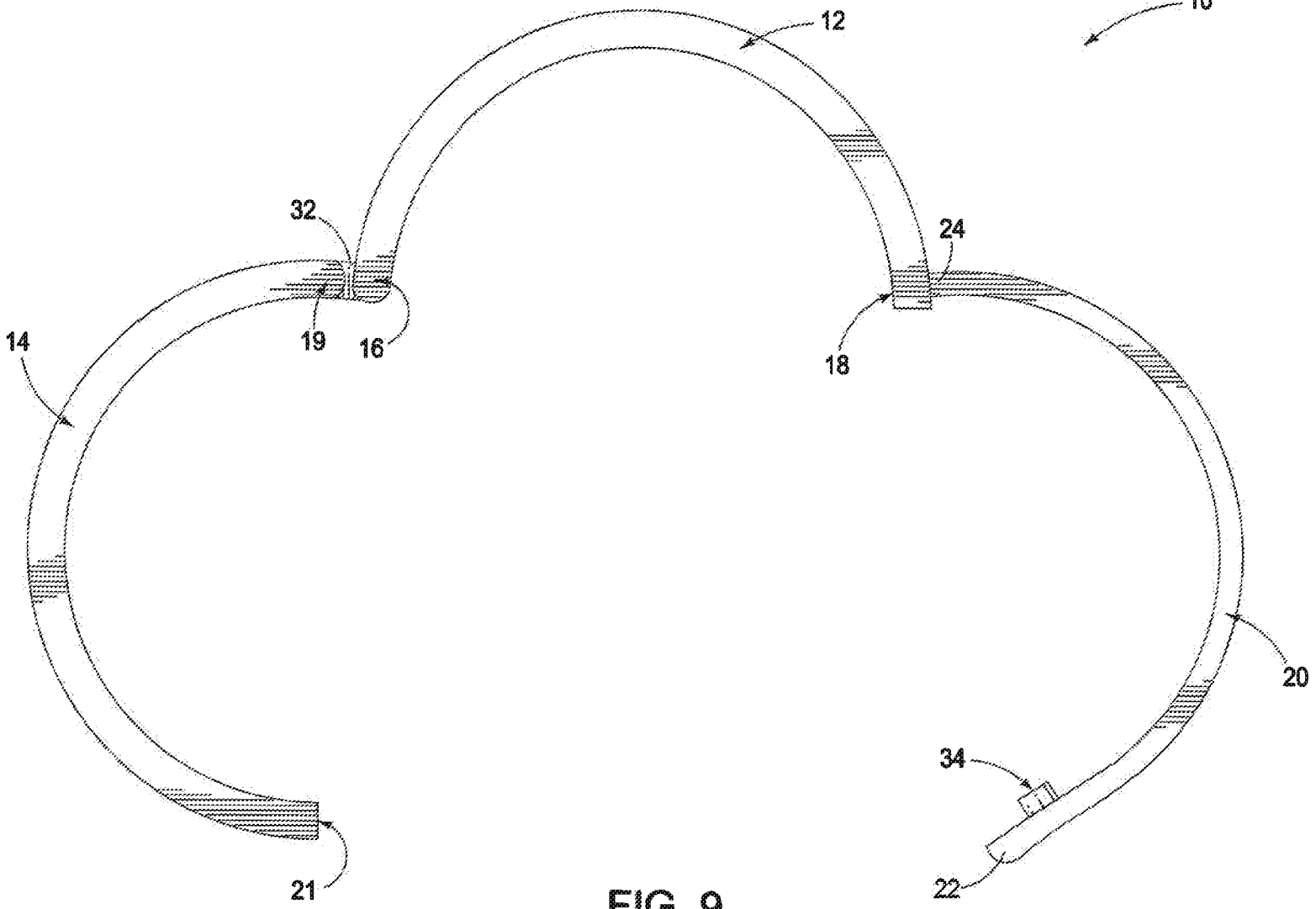
FIG. 9 is a side view of the FIG. 1 jewelry in the open orientation.

Referring to FIGS. 1-9, a first exemplary embodiment 10 of the inventive jewelry is shown. FIGS. 1-6 illustrate jewelry 10 in an exemplary closed position (or orientation). FIGS. 7-9 illustrate the jewelry 10 in an exemplary open position (or orientation). Since this first embodiment 10 can represent several configurations of jewelry such as a ring, necklace, wrist watch or bracelet, this first embodiment 10 may be referred to any one classification (reference) interchangeably. That is, the variety of possible term selections for the inventive jewelry demonstrates that the embodiments disclosed throughout this document represent a variety of possible jewelry configurations.

Referring to FIGS. 1-9, jewelry 10 includes an arcuate or curved first body 12 (first element; first body element or portion; primary or main body portion or element) that comprises a first partial loop terminating in a first end 16 opposite a second end 18. Jewelry 10 further includes an arcuate or curved second body 14 (second element; secondary body or element; second body element or portion) that comprises a second partial loop terminating in a first end 19 opposite a second end 21. The first end 19 of the second body 14 is pivotably secured to the first end 16 of the first body 12. Accordingly, the first and second bodies 12, 14 are capable of a pivoting action relative to each other wherein ultimately the first and second bodies 12, 14 can establish a complete loop in the closed position. That is, the second end 21 of the second body 14 will rest adjacent or against the second end 18 of the first body 12. An embodiment of jewelry 10 additionally includes an arcuate or curved third body 20 (third element; third body element or portion) pivotably secured to the second end 18 of the first body 12. Third body 20 will be discussed more thoroughly subsequently.

Still referring to FIGS. 1-9, first ends 16, 19 of the first and second bodies 12 and 14, respectively, have curved or rounded configurations (designs) to facilitate pivot action between the respective bodies 12, 14. Alternatively, the first ends 16, 19 of the first and second bodies 12 and 14, respectively, can have different configurations such as flat or planar configurations. The second ends 18, 21 of the first and second bodies 12 and 14, respectively, have flat or planar configurations to facilitate abutment (or proximate) engagement. Alternatively, the second ends 18, 21 of the first and second bodies 12 and 14, respectively, can have different configurations such as curved or rounded configurations (designs).

Extending outwardly from the first end 19 of the second body 14 is a hinge element 32 which is received in a complementary-configured opening 33 in the first end 16 of first body 12. Hinge element 32 is a pivot mechanism that provides the pivot action (engagement, cooperation) between the first and second bodies 12, 14. Extending outwardly from a second end 24 of the third body 20 (FIGS. 1, 4 and 7) is a hinge element 30 (FIGS. 1, 4 and 7) which is received in a complementary-configured opening in the second end 18 of first body 12. Hinge element 30 is a pivot mechanism that provides the pivot action (engagement, cooperation) between the first and third bodies 12, 20, respectively.

It should be understood that collectively any hinge element disclosed in this document for any jewelry and corresponding respective ends connected by the hinge element can be referred to as a joint for any embodiment of jewelry disclosed in this document.

Referring to FIGS. 1-6, in the closed orientation or position for jewelry (or ring) 10, the second ends 18, 21 of the first and second bodies 12 and 14, respectively, are pivoted toward each other (if originally in an open orientation) until the second ends 18, 21 abut against or adjacent each other. In the closed orientation, jewelry 10 establishes the continuous, completed loop structure shown (FIGS. 1-6). The third body 20 is positioned or oriented over the second body 14 and rests in a trench or groove (recess, planar recess, channel, planar channel, passageway) 26 (FIG. 8) defined in an upper or outer periphery (surface) of the second body 14. Accordingly, in this exemplary embodiment, the third body 20 has a smaller width dimension than the width dimension of the second body 14. Moreover, in this embodiment, the first body 12 has a width dimension substantially the same as the second body 14.

Referring to FIGS. 1-9, to open jewelry 10 from the closed orientation includes the following method steps. Pivoting the third body 20 away from the second body 14 and out of trench 26 away from the completed loop configuration (defined by first and second bodies 12 and 14). Next, pivoting the second end 21 of the second body 14 away from the second end 18 of the first body 12. Referring to FIG. 9, in the open configuration shown from the side view, the first and second bodies 12 and 14 establish a first cursive "w and third bodies 12 and 20 establish a second cursive "w" with first body 12 present in both first and second cursive "w"s.

Still referring to FIGS. 1-9, the curved third body 20 of ring 10 has a first end 22 opposite the second end 24. The hinge element 30 extends from the second end 24 of the third body 20. In one exemplary embodiment of ring 10, first and second bodies 12 and 14 have the same width and third body 20 has a narrower width to be received in trench 26. The trench 26 (FIG. 8) is defined in an upper, outer periphery surface of second body 14 and is configured and dimensioned (sized) to receive third body 20.

A cylindrical projection or knob (locking pin or locking knob) 34 (FIG. 8) extends from an inner or lower periphery (surface) of third body 20 proximate first end 22. An opening (aperture, recess, notch, indentation or hole) 28 in trench 26 proximate first end 19 of the second body 14 (and proximate hinge element 32) is provided through an entire structure of the second body 14. Opening 28 is configured and dimensioned to receive projection 34. In other embodiments, opening 28 does not extend entirely through structure of the second body 14 (through trench 26) but only extends partially through the second body 14 sufficiently to receive projection 34. In still other embodiments, projection 34 can have different geometric shapes (configurations) (as viewed from a top plan view) such has a square, rectangle, oval, variously configured triangles, variously configured parallelograms, hexagon, lozenge, diamond, etc. Opening 28 would be designed to receive the differently configured projection 34. Having locking pin 34 in opening 28 facilitates keeping the ring 10 in the closed orientation.

Figure 1:
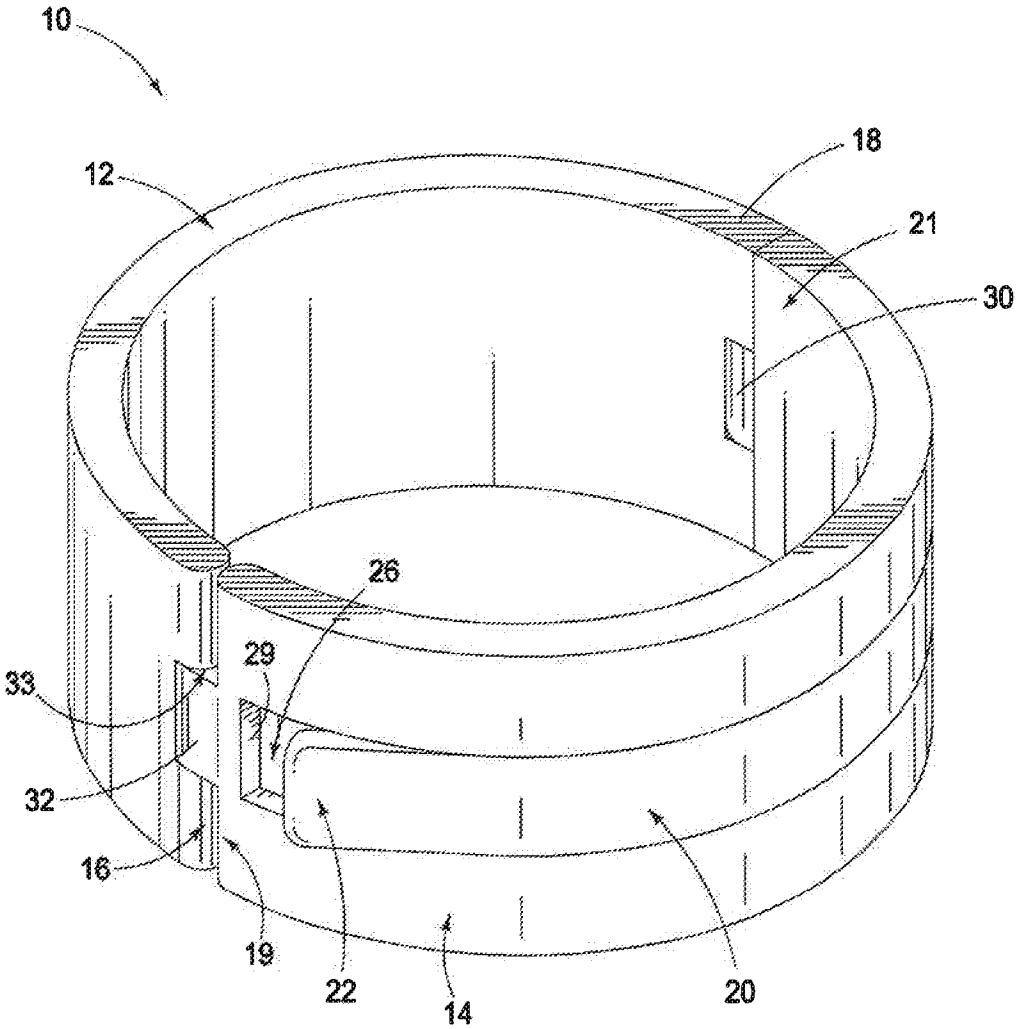
FIG. 1 is a perspective view of jewelry in a closed orientation according to an embodiment of the invention.
Figure 4:
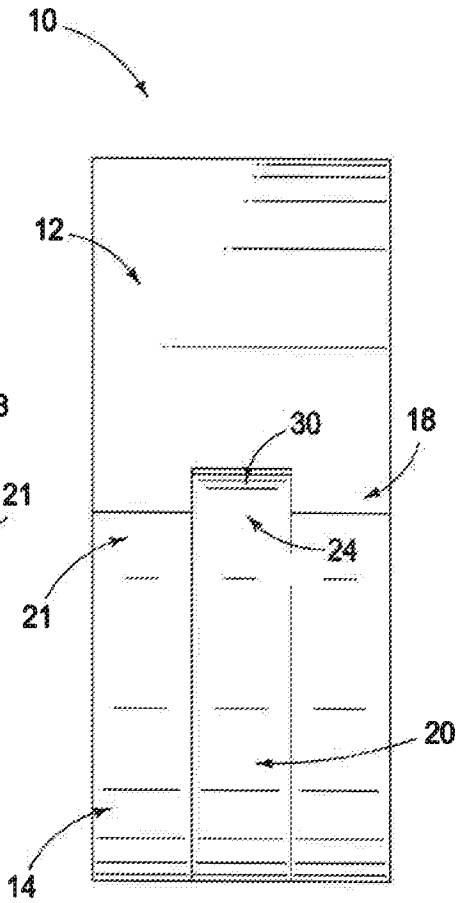
FIG. 4 is a view of FIG. 2 from the right side.
Figure 2:
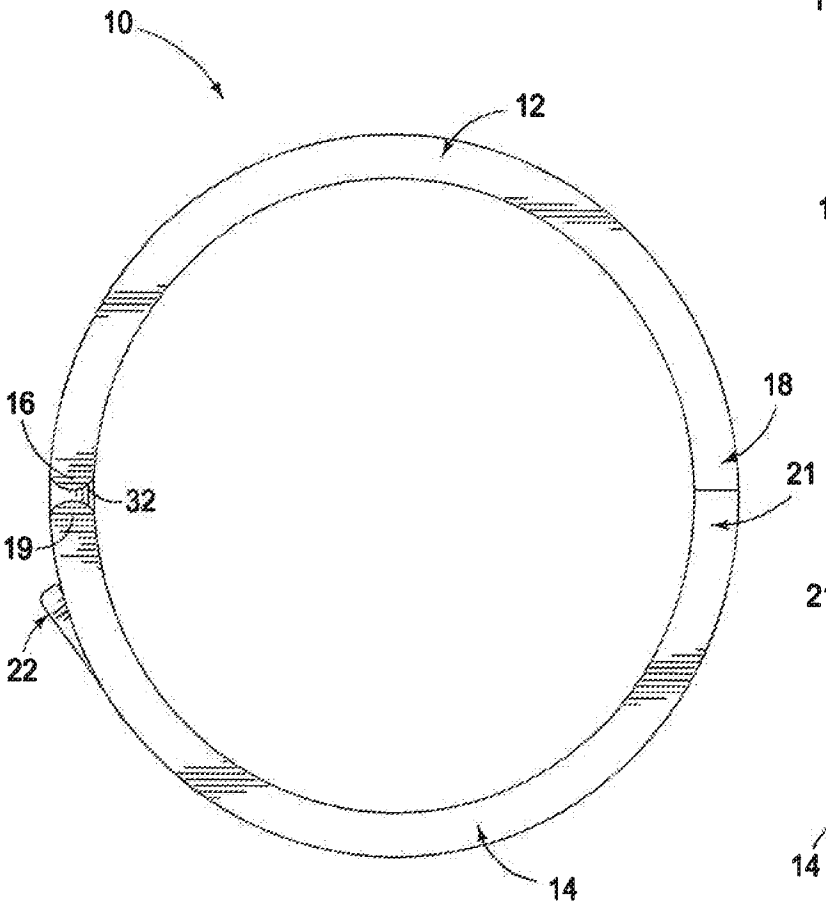
FIG. 2 is a side view of FIG. 1.
Figure 3:
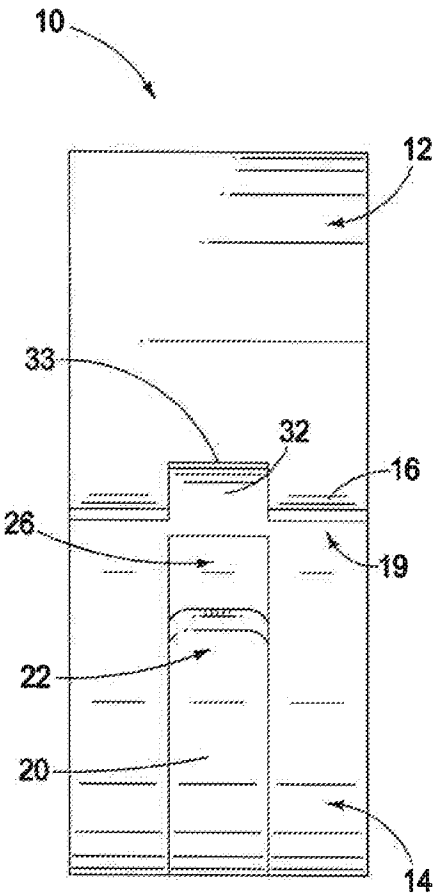
FIG. 3 is a view of FIG. 2 from the left side.
Figure 5:
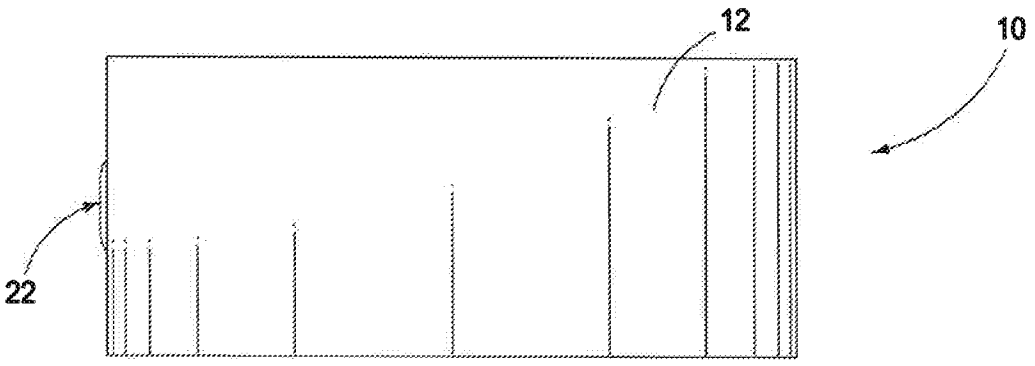
FIG. 5 is a view of FIG. 2 from the top side.
Figure 6:
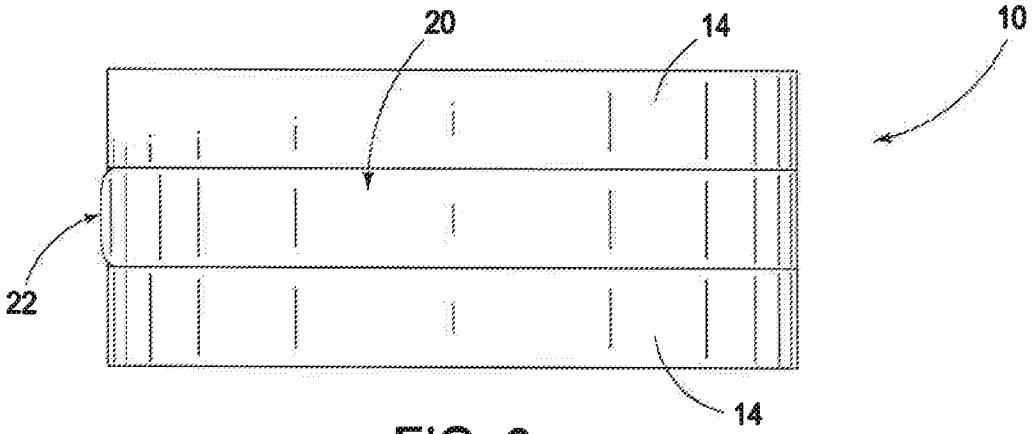
FIG. 6 is a view of FIG. 2 from the bottom side.

Referring to FIGS. 1-2 and the closed position again, the first and second bodies 12 and 14 are arranged in the closed, completed loop configuration with the third body 20 received in trench 26 of the second body 14. Not shown is the projection 34 resting in opening 28. Exposed from trench 26 and elevationally above the outer periphery of the second body 14 is the first end 22 of the third body 20. This configuration is established by the first end 22 having a planar structure relative to a majority of the rest to the structure of the third body 20 which is curved. The first end 22 of the third body 20 is also spaced from a terminal end 29 of trench 26. Both of these design considerations for the first end 22 facilitates finger engagement of the third body 20 when pivoting the third body 20 out of the trench 26 to begin opening jewelry 10.

It should be understood that in other embodiments, the first end 22 of third body 20 can have the same curved configuration as the balance of the third body 20 wherein the first end 22 will not be exposed from the trench 26. Moreover, it should be understood that the first end 22 can be configured to abut against or proximate the terminal end 29 of trench 26.

It should be further understood that having the third body 20 positioned in trench 26 provides the benefit of securing jewelry 10 in the closed configuration. Increasing the degree of securement of jewelry 10 in the closed configuration is having the projection 34 secured in opening 28.

As implied previously, the majority of the configuration of third body 20 has a curvature configuration that is complimentary to, or the same as, the curvature configuration of second body 14. If the trench 26 has a depth dimension approximately equal with, or coincides with, the side thickness dimension of the third body 20, then the outer surface of third body 20 will be congruent or planar (or coincides or compliments) with the outer surface of second body 14 when the third body 20 is positioned in trench 26. Alternatively, if the dimensions do not coincide, the outer surface of third body 20 can rest below, or above, the outer surface of second body 14. These differing configurations and dimensions offer differing aesthetic perspectives for jewelry 10. Moreover, if the dimensions do not coincide and the outer surface of third body 20 rests below or above the outer surface of second body 14, this facilitates finger engagement of jewelry 10 for gripping jewelry 10 to move or slide jewelry from the position on the body.

A method to open jewelry 10 from the closed position (FIG. 1) includes a first force (a lifting force) applied in a first, upward direction to the first end 22 of third body 20 by a finger (and/or fingernail) to pivot the third body 20 on hinge element 30 (FIG. 7) and pry the projection 34 out of opening 28. Continuing the first force pivots the third body 20 out of trench 26 and away from the second body 14 to allow access to the second body 14. The second body 14 is grasped by a finger (and/or thumb and finger) and a second force is applied in a second, upward direction, and opposite to the first direction, to pivot the second body 14 on hinge element 32. The second body 14 pivots away from the first body 12 (in the opposite direction as the pivot direction of the third body 20) wherein ultimately jewelry 10 rests in the open orientation (see FIGS. 7-9).

A method to close ring 10 from the open position (orientation), pressure or a force is applied to one, or both, of the outer surfaces of the first and second bodies 12 and 14 forcing the two bodies to pivot on hinge element 32 while the third body 20 remains in the "pulled back" position. The pivot action will continue until the second end 21 of the second body 14 is adjacent or abuts against the second end 18 of the first body 12 wherein jewelry 10 establishes the closed loop configuration. Next, a force or pressure is applied to the outer surface of the third body 20 forcing the third body 20 to pivot on hinge element 30 in a direction toward the second body 14. The pivot action will continue until the third body 20 rests in trench 26 and a force is continued to "snap" projection 34 into opening 28.

Still referring to FIGS. 1-9, jewelry 10 can have numerous dimensions. In this exemplary embodiment, the width of first and second bodies 12 and 14 are the same. Each have a width generally three times the width dimension of the third body 20. Accordingly, when jewelry 10 is configured with trench 26 formed in the center of the second body 14, the two exposed outer surfaces of the second body 14 at opposite sides of the trench 26 will have generally the same width dimensions as the width of the third body 20 (and the two exposed outer surfaces of the second body 14 have generally the same widths). It should be understood that trench 26 does not have to be positioned in the center of the second body 14, and therefore, can be positioned more proximate to either edge of the second body 14.

It should be understood that the components of jewelry disclosed throughout this document can have numerous names or descriptions. For the example, first body is a pivot arm or support arm, the second body is a grooved arm or seating arm, and the third body is a locking arm. Moreover, another embodiment of jewelry described more thoroughly below can include a locking clamp. Furthermore, another embodiment of jewelry described more thoroughly below can include a restraining collar or clasp. Additionally, another embodiment of jewelry described more thoroughly below can include a restraining collar and a locking clamp. Still further, the projection in the third body and the corresponding opening in the second body described above can be referred to as a raised bead (or button) and a hole, respectively. This bead/button (projection) fits securely into the hole defined in the seating arm (second body). This makes a positive lock that cannot accidentally come open and can only be opened by physically lifting the locking arm and button out of the hole.

Referring to FIGS. 10-16, a second exemplary embodiment 50 of the inventive jewelry 50 is shown. Structure of this second embodiment 50 that is the same as the structure in the first described embodiment above may not be numbered nor described. Alternatively, the same structure may be numbered with the same reference number as used in first embodiment, or with a different reference number, with or without further description. That is, the same structures and the same aspects of the method for opening and closing the jewelry (the cooperation between respective structures) may not be described again.

Since this second embodiment 50 can represent several configurations of jewelry such as a ring, necklace, wrist watch or bracelet, this second embodiment 50 may be referred to as jewelry, ring, necklace, wrist watch or bracelet. That is, the variety of possible term selections demonstrates that the embodiments disclosed in this document represent a variety of possible jewelry configurations.

Referring to FIGS. 10-16, jewelry (ring or bracelet) 50 includes a first body 52 and a second body 54 that have differing width 53 dimensions (see FIG. 10) than the width dimensions of the first embodiment 10 previously described. These differing width dimensions accommodate the jewelry configuration being routinely used in one fashion versus another fashion, for example, a ring versus a bracelet or necklace. The differing widths can be smaller or larger than those disclosed by the respective embodiments disclosed in this document.

Figure 10:
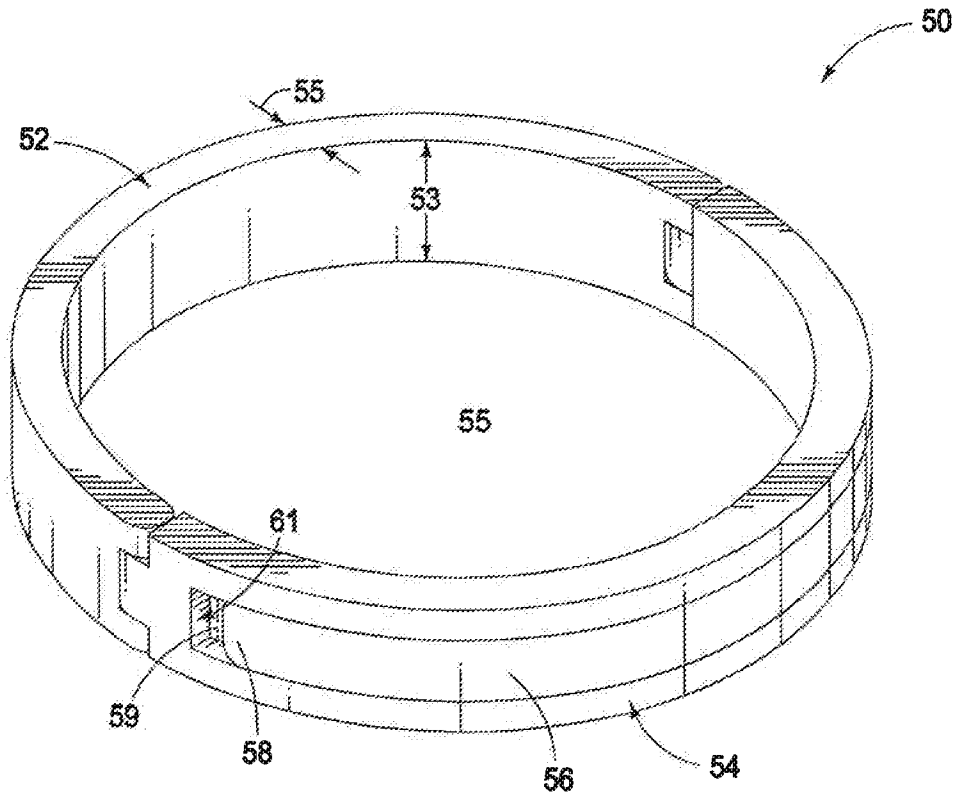
FIG. 10 is a perspective view of jewelry in a closed orientation according to another embodiment of the invention.
Figure 13:
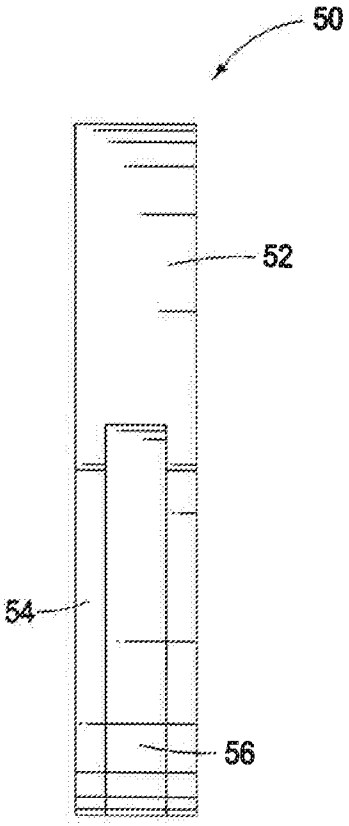
FIG. 13 is a view of FIG. 11 from the right side.
Figure 11:
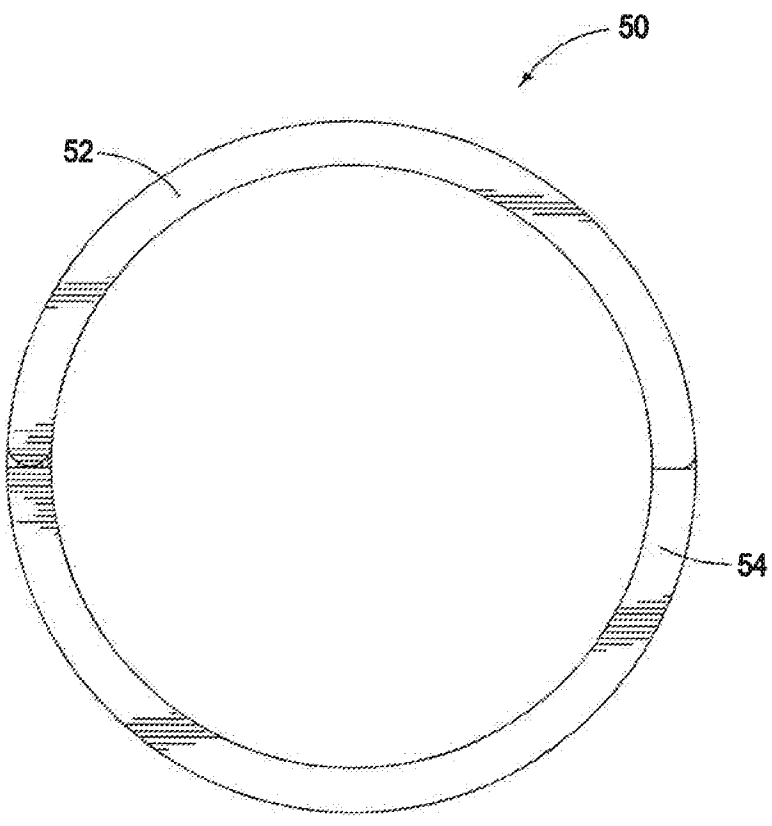
FIG. 11 is a side view of FIG. 10.
Figure 12:
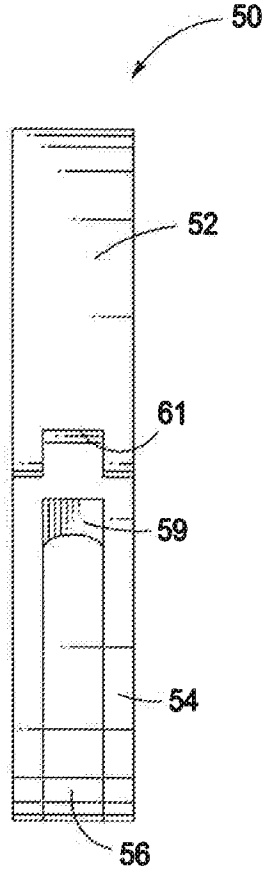
FIG. 12 is a view of FIG. 11 from the left side.
Figure 14:
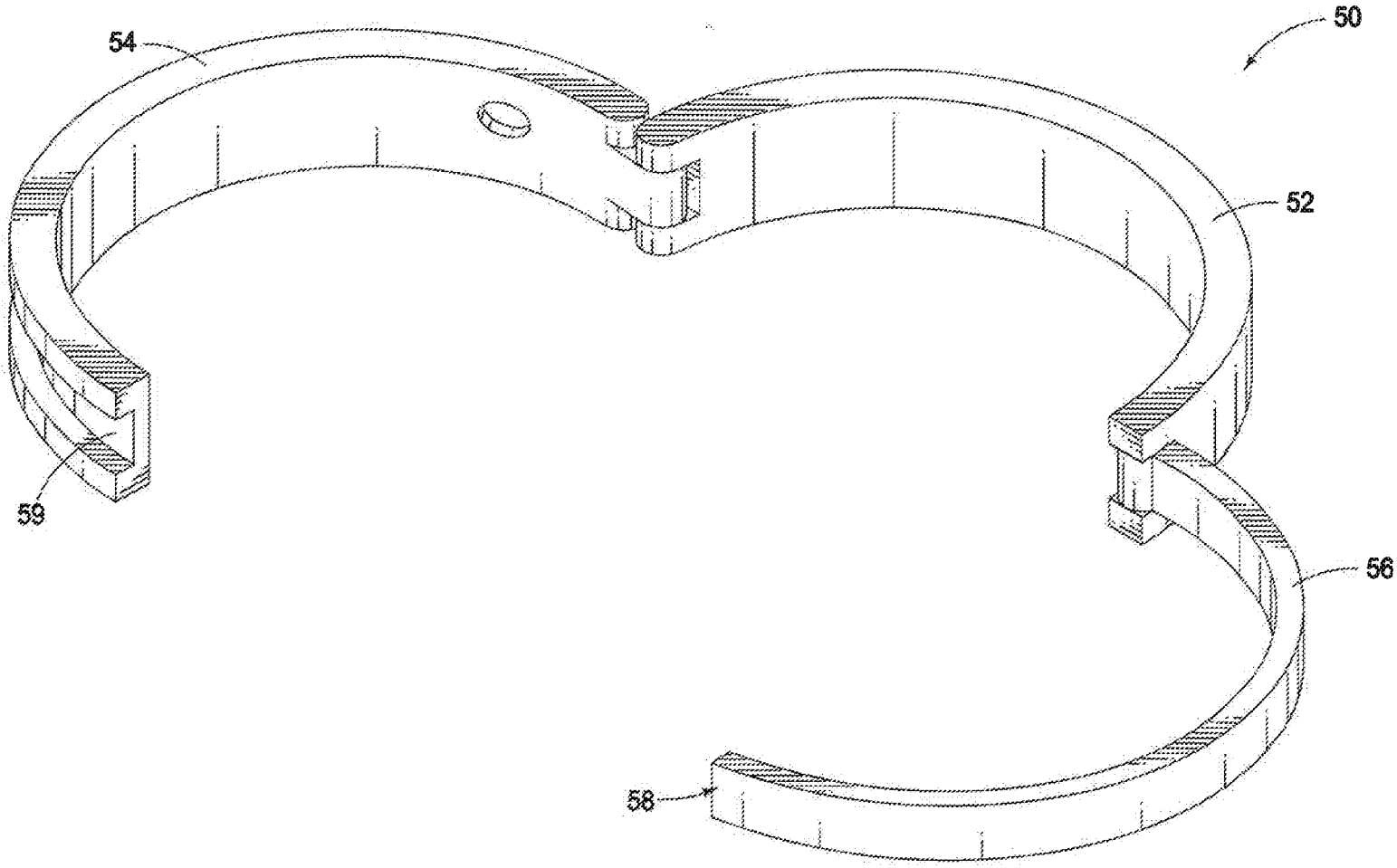
FIG. 14 is a perspective view of the FIG. 10 jewelry in an open orientation illustrating mostly inner peripheries.
Figure 15:
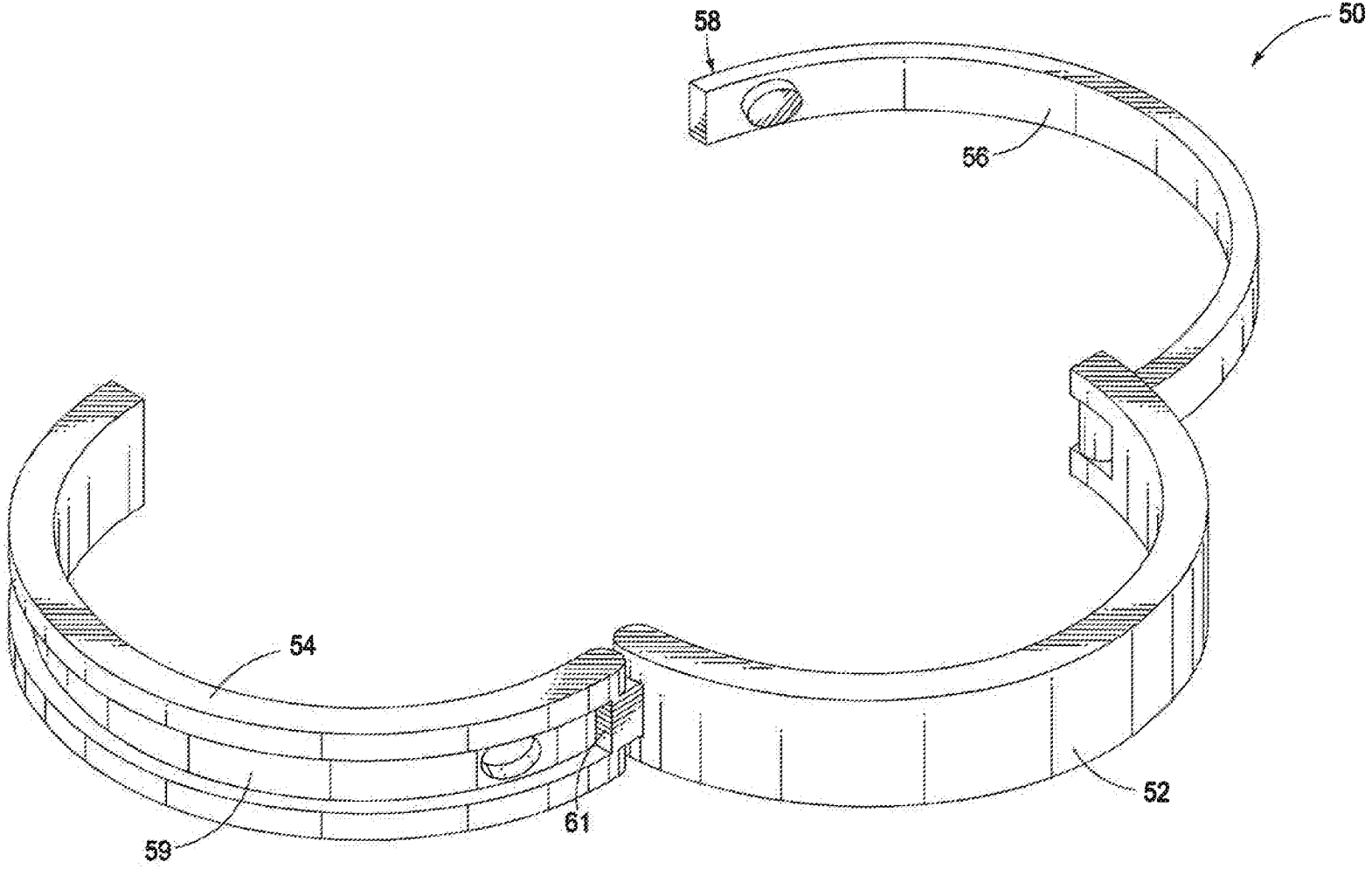
FIG. 15 is a perspective view of the FIG. 10 jewelry in the open orientation illustrating mostly outer peripheries.
Figure 16:
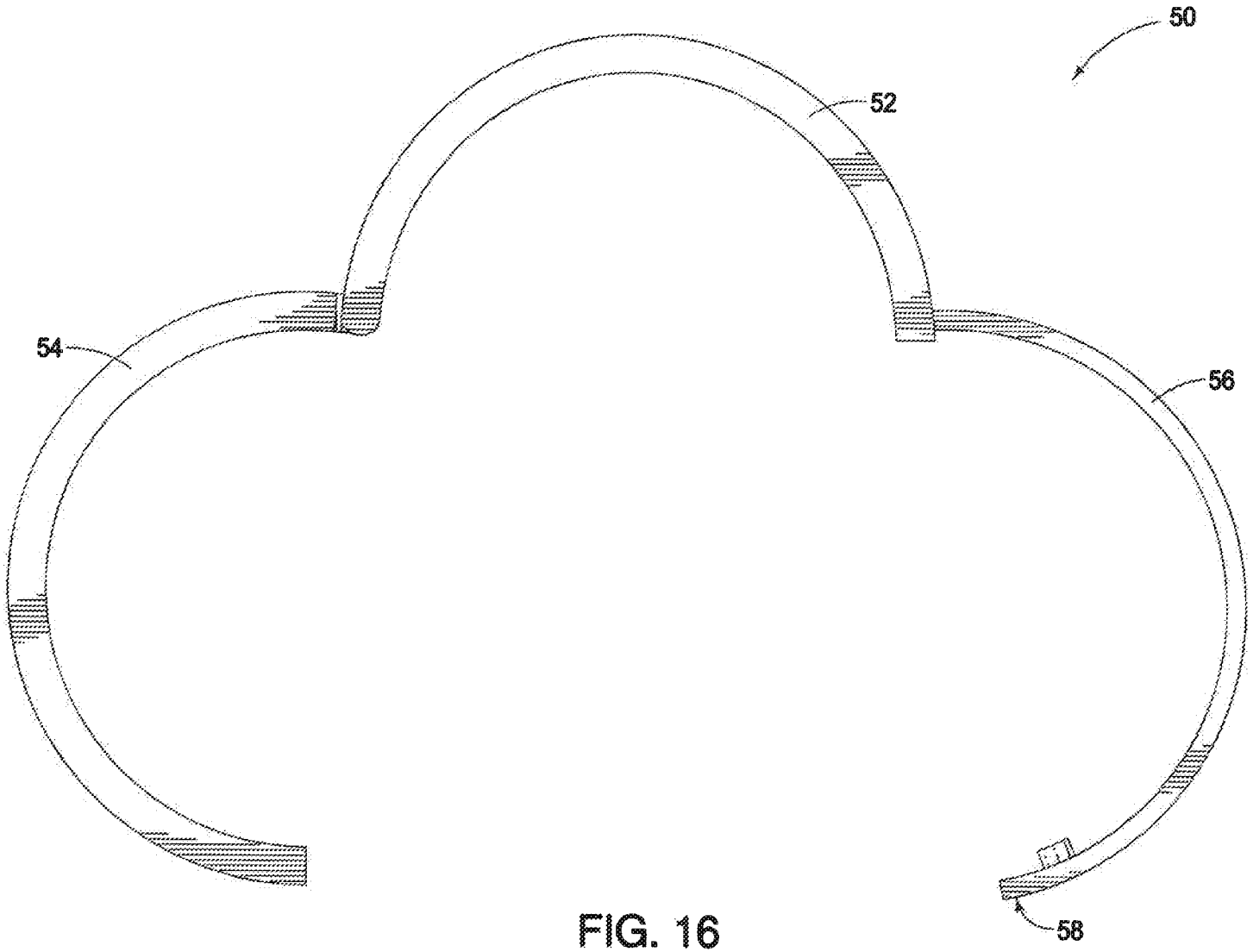
FIG. 16 is a side view of the FIG. 10 jewelry in the open orientation.

It should be understood that the direction for width dimensions for all of the embodiments of jewelry disclosed throughout this document will be along the same direction as disclosed in FIG. 10 at reference number 53. Moreover, it should be understood that the direction for thickness dimensions for all of the embodiments of jewelry disclosed throughout this document will be along the same direction as disclosed in FIG. 10 at reference number 55. Still further, it should be understood that the direction for length dimensions for all of the embodiments of jewelry disclosed throughout this document will be along the curved dimensions or distances of the perimeters or circumferences of the structures of the jewelry.

An exemplary embodiment of jewelry 50 includes the third body 56 having a curvature complimentary with the curvature of second body 54 wherein the outer surface or periphery of third body 56 is congruent or coincides with the outer surface or periphery of second body 54. That is, an entirety of the third body 56 structure has the curved configuration, including a terminal end (or first end) 58, resulting in the terminal end 58 not being exposed from a trench 59 in the second body 54. This configuration of the first end 58 of the third body 56 provides a differing aesthetic perspective relative to the configuration of the first embodiment 10. First end 58 of the third body 56 terminates in the trench 59 spaced from a terminal edge 61 of trench 59. This space allows for finger (and/or finger nail) engagement of the third body 56 to begin the opening procedure for bracelet 50 from the closed position.

Still referring to FIGS. 10-16, it should be noted that all three bodies 52, 54 and 56 have the same shape configuration except for the third body 56 not being as wide as the first and second bodies 52 and 54, and the second body 54 having trench 59. That is, each body is a plain, simple, arcuate structure wherein a pair of spaced smooth (uninterrupted by additional structure or shape configurations) surfaces, an upper arcuate surface or perimeter over and conformed with a lower arcuate surface or perimeter. The upper and lower surfaces are connected by smooth (uninterrupted by additional structure or shape configurations) side edges or walls that are parallel to each other. The trench 59 and third body 56 comprise the same shape configuration and have the same dimensions in the respective width dimension direction and the thickness dimension direction. It should be understood that the trench 59 and third body 56 can comprise the same dimensions in the respective circumferential (peripheral or length) dimension direction wherein a terminal front edge of the first end 58 of the third body 56 rests against or contact the terminal edge 61 of the trench 59.

It should be understood that all embodiments of jewelry disclosed throughout this document will have upper periphery surfaces for the respective three bodies (first, second and third bodies) wherein each has the same arc dimensions. That is, an entirety of the upper periphery surface of the third body has an arc dimension that is the same as an entirety of the upper periphery surface of the second body. Still further, an entirety of the upper periphery surface of the first body has an arc dimension that is the same as an entirety of the upper periphery surfaces of the second and third bodies.

Referring to FIGS. 17-22, a third exemplary embodiment 100 of the inventive jewelry is shown. Structure of this third embodiment 100 that is the same as the structure in the previously described embodiments above may not be numbered nor described. Alternatively, the same structure may be numbered with the same reference number as used in the previously described embodiments with, or without, further description. Still further, the same structure may be given a different reference number in this third embodiment 100. Since this third embodiment 100 can represent several configurations of jewelry such as a ring, necklace, wrist watch or bracelet, this third embodiment 100 may be referred to as jewelry, ring, necklace, wrist watch or bracelet. That is, the variety of possible term selections demonstrates that the embodiments disclosed in this document represent a variety of possible jewelry configurations.

Figure 17:
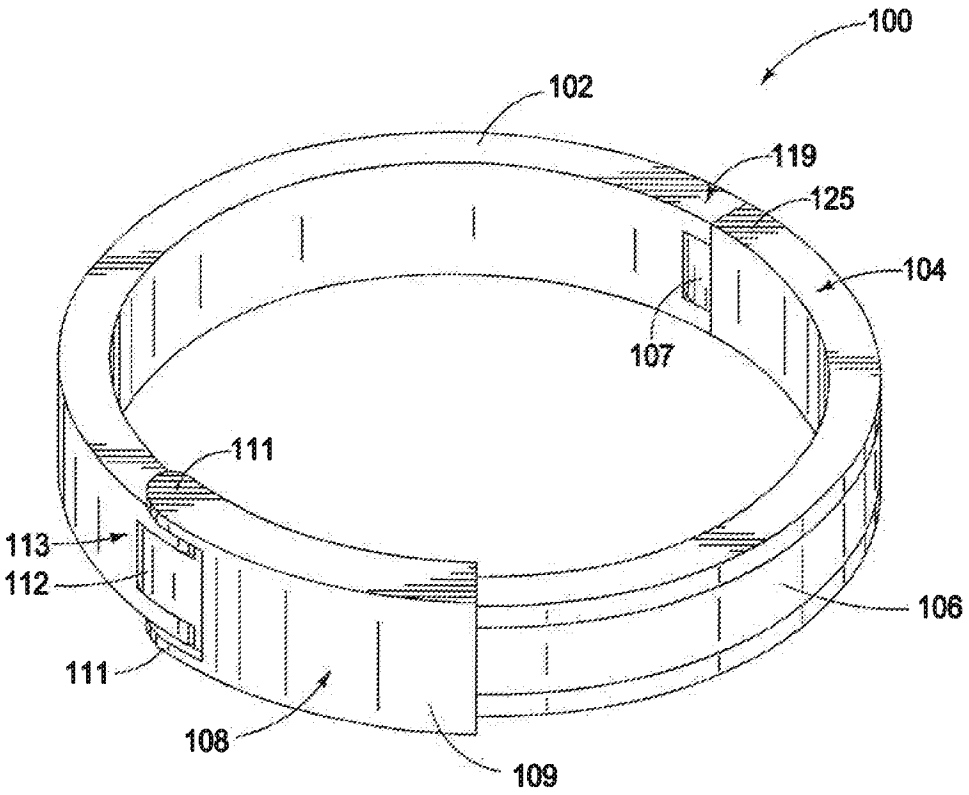
FIG. 17 is a perspective view of jewelry in a closed orientation according to another embodiment of the invention.
Figure 20:
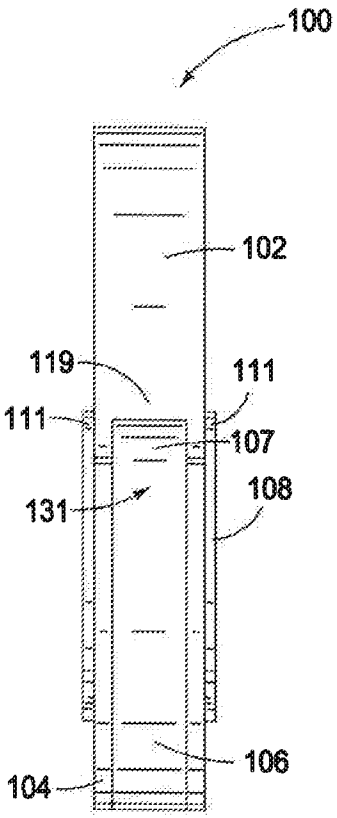
FIG. 20 is a view of FIG. 18 from the right side.
Figure 18:
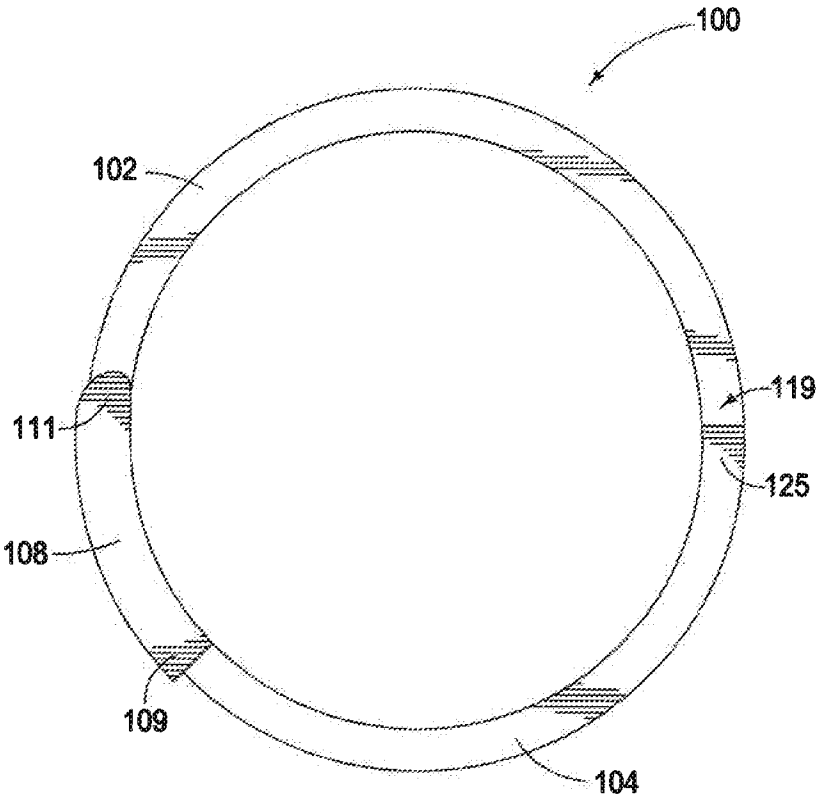
FIG. 18 is a side view of FIG. 17.
Figure 19:
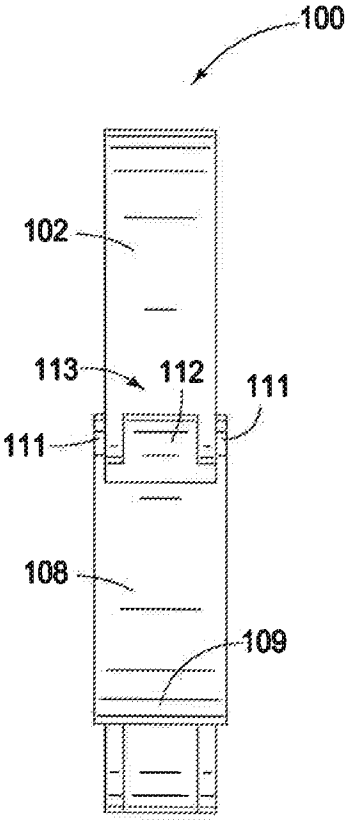
FIG. 19 is a view of FIG. 18 from the left side.

Referring to FIGS. 17-22, this third embodiment for jewelry 100 includes a first body 102 pivotably secured to second body 104 via hinge element 112 (see FIGS. 17 and 19). First end 113 of the first body 102 houses (receives) hinge element 112 which extends from the first end 130 of the second body 104 (see FIGS. 21-22). Second end 119 of the first body 102 houses (receives) hinge element 107 that extends from the first end 131 of the third body 106. Second end 125 of the second body 104 rests adjacent or against the second end 119 of the first body 102 in the closed orientation (see FIGS. 17-18).

Jewelry 100 includes a clasp 108 not presented in the previously described embodiments. It should be understood that the previously described embodiments of jewelry could include a clasp, including any embodiment of jewelry described in this document. Clasp 108 is pivotably secured to outer edges (sides) of first body 102 at the first end 113 and is configured as a three-sided (three surfaces) curved (arcuate) rectangle lacking a bottom side or surface. Clasp 108 includes a front end 109 for finger (and/or fingernail) engagement and an opposite end configured as a pair of ears 111 spaced apart in a parallel relationship. The pair of ears 111 is (or receives described subsequently) the pivot mechanism for clasp 108 and provides the pivoting action of clasp 108 to the first body 102 at the first end 113. In this configuration, the pivoting action of clasp 108 moves the front end 109 toward, and alternatively away from, the second body 104.

The clasp 108 provides a differing aesthetic aspect relative to an embodiment of jewelry that does not have a clasp. Furthermore, clasp 108 supports maintaining jewelry 100 in the closed orientation. Still further, the clasp 108 enhances maintaining the third body 106 in trench (recess, aperture, notch, indentation or opening) 118 (FIG. 21) of second body 104. It should be understood that clasp (clamp) 108 can be pivotably secured to the first body 102 farther down the structure from the first end 113. Moreover, it should be understood that clasp 108 can be pivotably secured to the second body 104 instead of the first body 102.

Still referring to FIGS. 17-20, in the closed orientation for jewelry 100, the clasp (or clamp) 108 is received over or adjacent (or against) a portion of three sides or surfaces of the second body 104 and upper surface of the third body. Clasp 108 may be configured to abut against one or more of second and third bodies 104 and 106, and alternatively, may not abut against any one of the bodies 104 and 106. In either configuration, clasp 108 is positioned over portions of the second body 104 and third body 106. Clasp 108 has the ears 111 pivotably secured to opposite sides of the first body 102 proximate the hinge element 112. The hinge element 112 pivotably couples first and second bodies 102 and 104. The curvature of clasp 108 may, or may not, be complimentary to the curvature configuration of one or more of the second and third bodies 104 and 106 for differing aesthetic considerations. Alternatively, clasp 108 may have more of a planar configuration to provide a differing aesthetic consideration and a differing degree for facilitating finger engagement at the front end 109 of clasp 108. In operation, clasp 108 pivots to open from, and close over, the second and third bodies 104 and 106. It should be understood that any embodiment of jewelry disclosed in this document may, or may not, have the clasp structure.

A method to open jewelry 100 from the closed orientation includes the following steps. The front end 109 of clasp 108 is engaged by a finger and a lifting force or pressure is applied to pry the front end 109 of clasp 108 away from the second and third bodies 104 and 106. Clasp 108 is maintained in the closed position by a pair of knobs (lugs, projections or nose) 114 (see FIGS. 21-22) (only one shown in these views) extending from opposite inner walls (or surfaces) of clasp 108 and which are configured to be received in corresponding openings 118 (only one shown in these views) in opposite side walls (or surfaces) of second body 104. In other embodiments, knobs 114 could extend from opposite side walls (or surfaces) of second body 104 and configured to be received in corresponding openings 118 in opposite inner walls (or surfaces) of clasp 108. It should be understood that any embodiment of jewelry disclosed in this document may, or may not, have the knob and corresponding opening.

Still addressing the method to open jewelry 100, once clasp 108 is pivoted away from the second and third bodies 104 and 106, front end (second end) 115 of the third body 106 is exposed. Front end 115 is engaged by a finger to pry third body 106 away from second body 104. The prying action or force applied to third body 106 must be sufficient to remove the knob 116 from opening 117 in the second body 104. Once the third body 106 is pivoted out of trench 118 of the second body 104 away from the second body 104, the first or second body 102 and 104 (or both) is engaged and pivoted away from the other (or each other).

Figure 21:
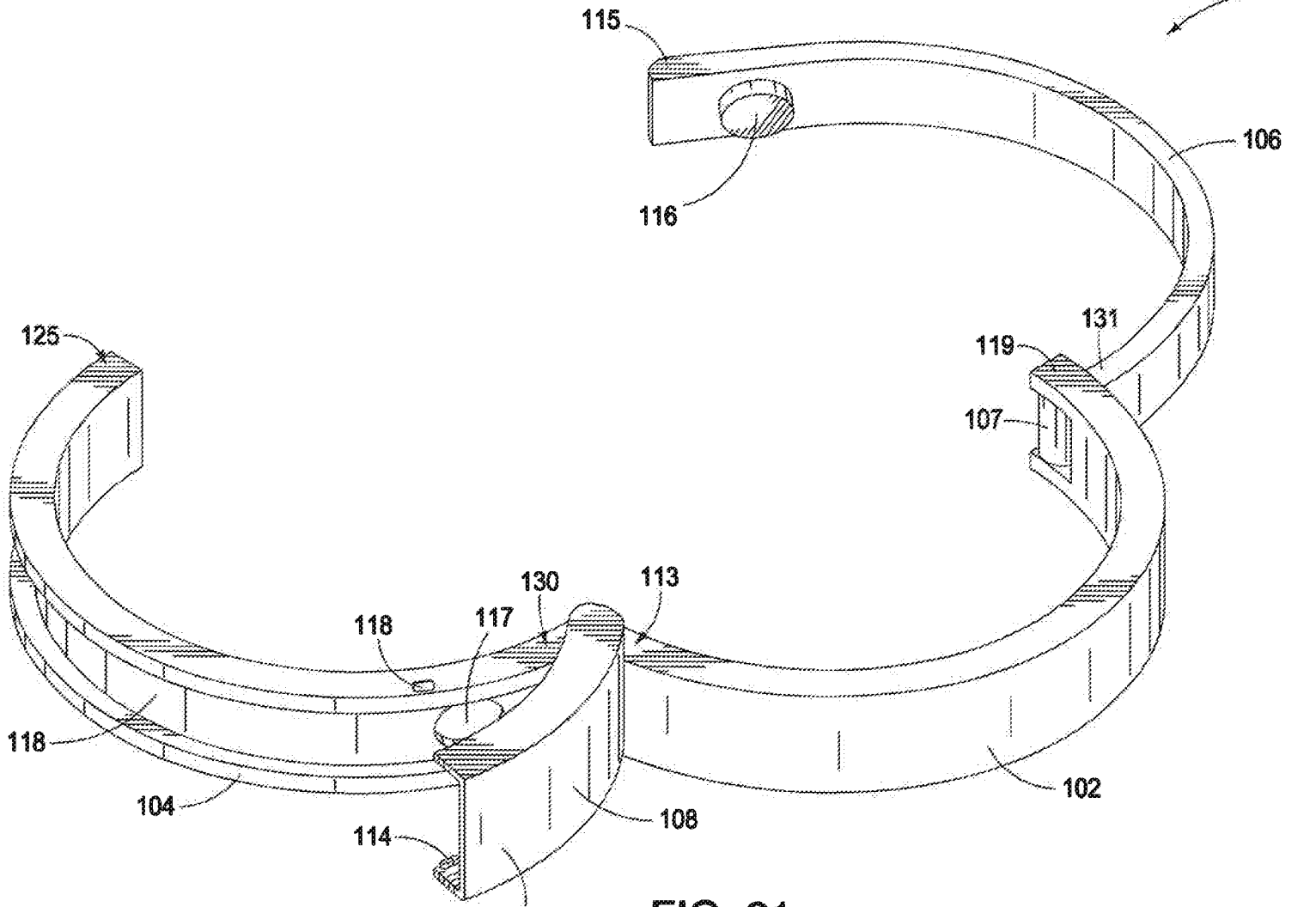
FIG. 21 is a perspective view of the FIG. 17 jewelry in an open orientation illustrating mostly outer peripheries.
Figure 22:
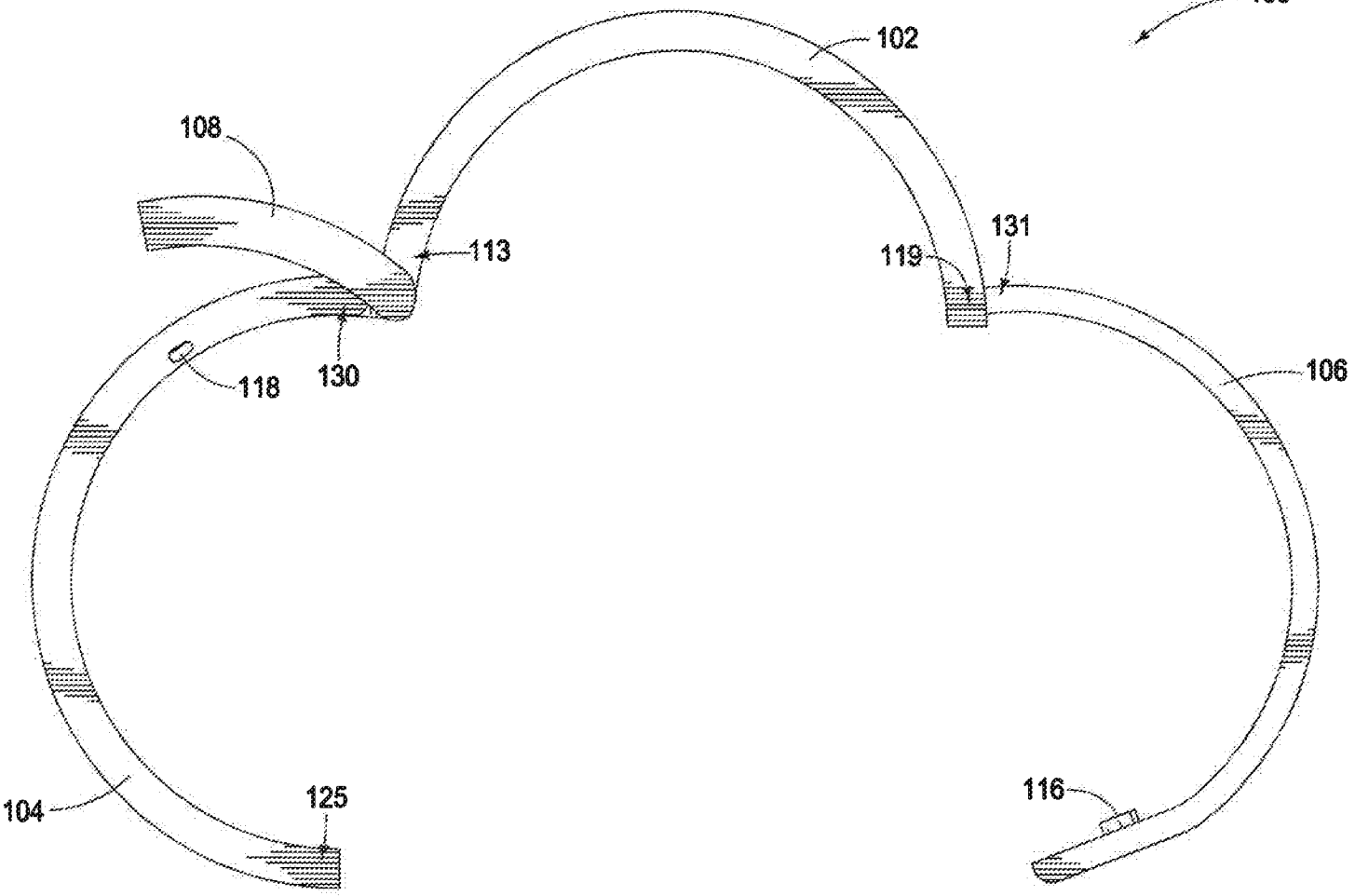
FIG. 22 is a side view of the FIG. 17 jewelry in the open orientation.
Figure 23:
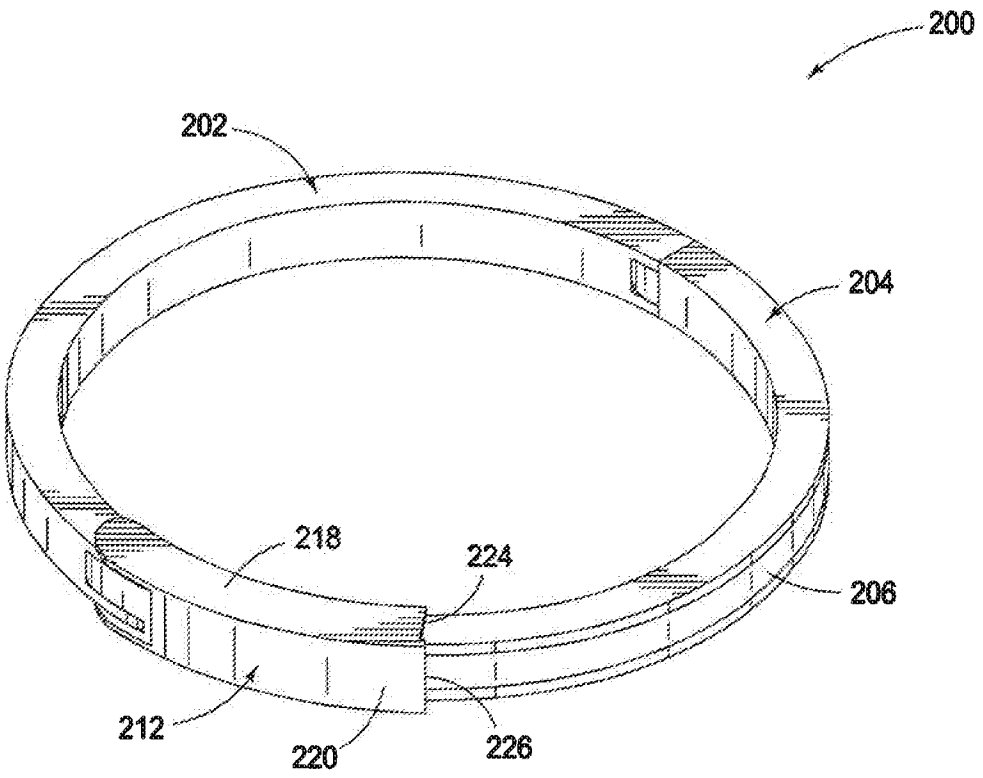
FIG. 23 is a perspective view of jewelry in a closed orientation according to another embodiment of the invention.
Figure 26:
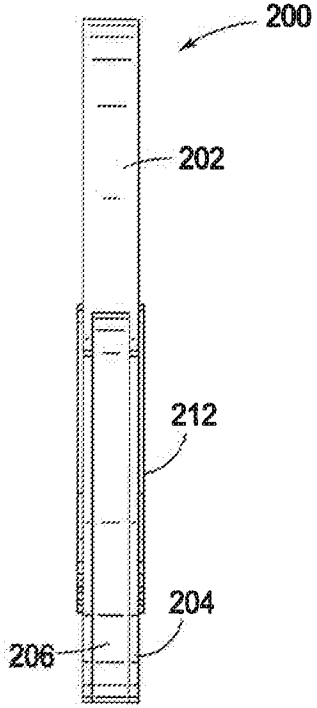
FIG. 26 is a view of FIG. 24 from the right side.

Exemplary method steps to close jewelry 100 from the open position of FIGS. 21-22 is by reversing the method steps just described to open jewelry 100 from the closed position. Consequently, the first step would be to pivot the second body 104 until the second end 125 rests against or adjacent the second end 119 of the first body 102 to complete a loop between first and second bodies 102 and 104. Third body 106 is then pivoted onto the second body 104 to be received in trench 118 with knob 116 secured in opening 117. Then clasp 108 is pivoted over the second and third bodies 104 and 106 until the knobs 114 are received in openings 118.

Referring to FIGS. 23-30, a fourth exemplary embodiment 200 of the inventive jewelry is shown. Structure of this fourth embodiment 200 that is the same as the structure in the previously described embodiments above may not be numbered nor described. Alternatively, the same structure may be numbered with the same reference number as used in the previous embodiments with, or without, further description. Still further, the same structure may be given a different reference number in this fourth embodiment 200. Since this fourth embodiment 200 can represent several configurations of jewelry such as a ring, necklace, wrist watch or bracelet, this fourth embodiment 200 may be referred to as jewelry, ring, necklace, wrist watch or bracelet. That is, the variety of possible term selections demonstrates that the embodiments disclosed throughout this document represent a variety of possible jewelry configurations.

Referring to FIGS. 23-30, a fourth embodiment of jewelry 200 is illustrated and includes a first body 202, a second body 204, a third body 206 and a clasp 212 pivotably secured to the first body 202. Clasp 212 is configured as a three-sided (three surfaced) curved (arcuate) rectangular structure lacking a bottom side or surface. Clasp 212 is configured as a top arcuate surface 220 extending between two opposite sides 218 that extend downwardly in parallel relation. The opposite sides 218 terminate in front edges 224 and the top arcuate surface 220 terminates with a tab (finger tab) 226 that extends outwardly past the front edges 224 from the top arcuate surface 220. Tab 226 facilitates finger (and/or fingernail) engagement to pry clasp 212 from the second and third bodies 204 and 206 to begin opening of the jewelry 200 from the closed orientation.

Figure 29:
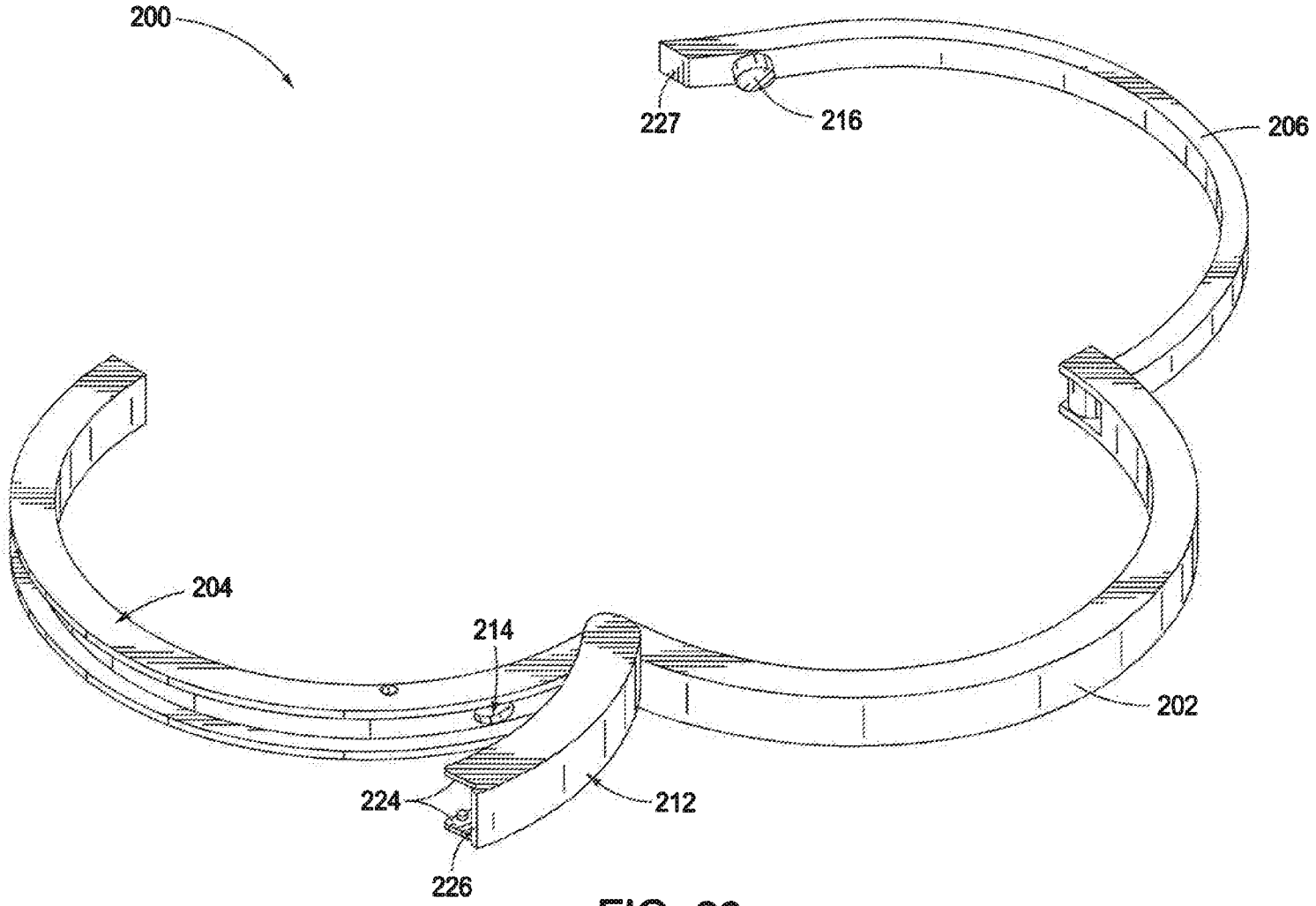
FIG. 29 is a perspective view of the FIG. 23 jewelry in an open orientation illustrating mostly outer peripheries.
Figure 30:
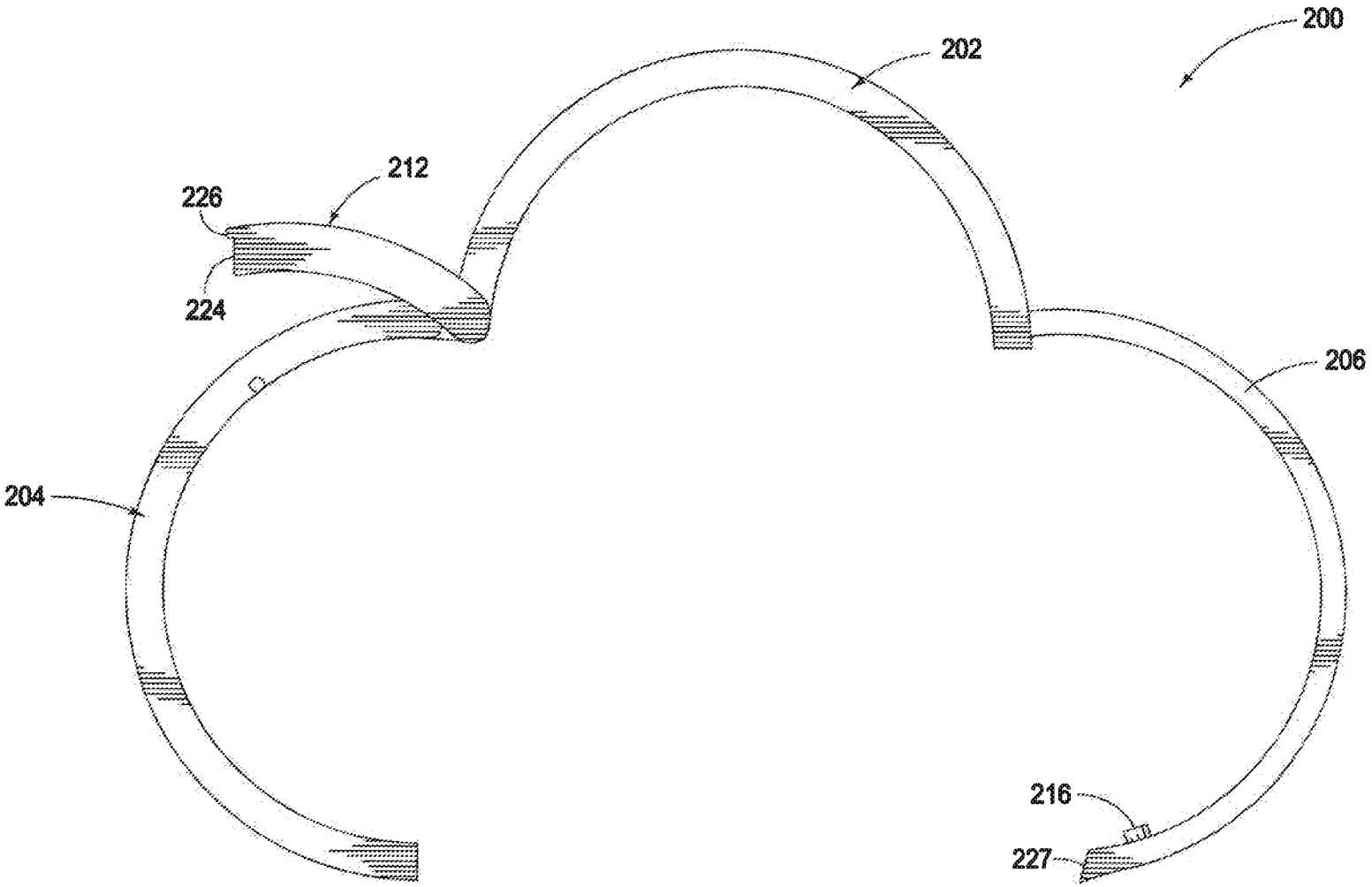
FIG. 30 is a side view of the FIG. 23 jewelry in the open orientation.

Referring to FIGS. 29-30, jewelry 200 has a terminal end face 227 (located proximate knob 216) of the third body 206 that is angled between upper and lower surfaces of the third body 206. The angled terminal end face 227 facilitates finger (and/or fingernail) engagement to pry the third body 206 from the first and second bodies 202 and 204 to continue opening of jewelry 200. It should be understood that any embodiment of jewelry disclosed in this document may, or may not, have the angled terminal end face.

Figure 27:
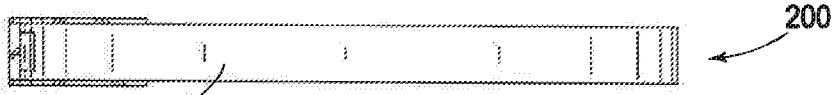
FIG. 27 is a view of FIG. 24 from the top side.
Figure 24:
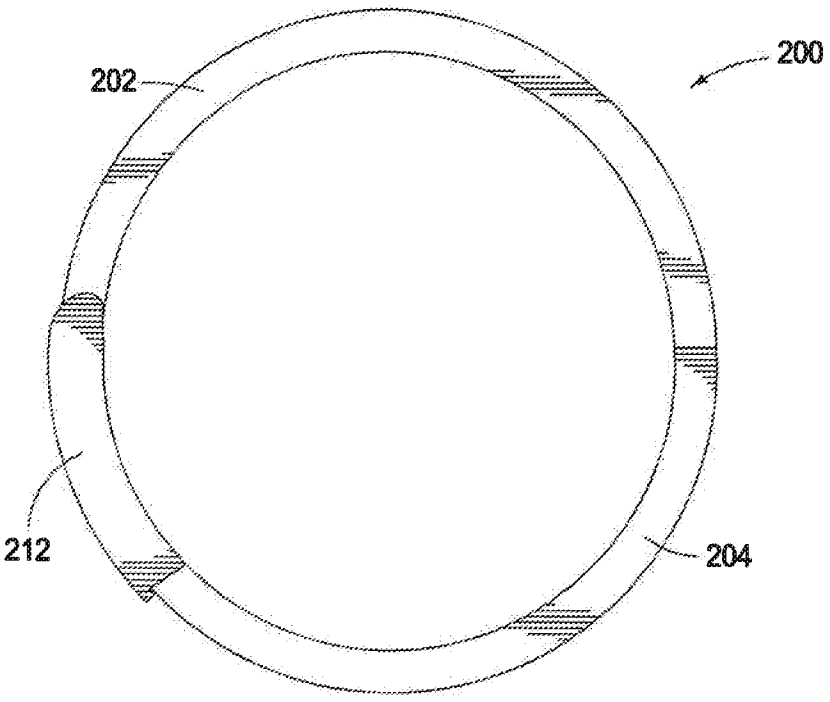
FIG. 24 is a side view of FIG. 23.
Figure 28:
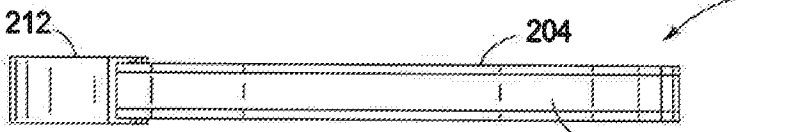
FIG. 28 is a view of FIG. 24 from the bottom side.
Figure 25:
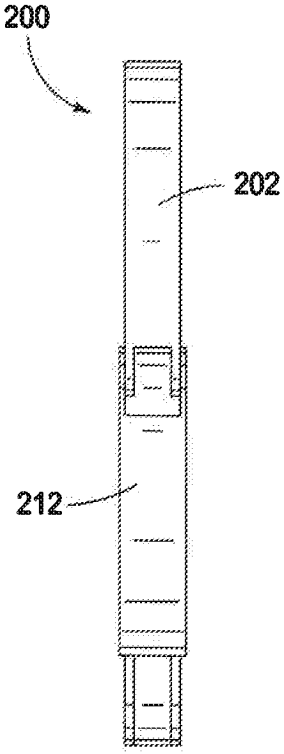
FIG. 25 is a view of FIG. 24 from the left side.
Figure 31:
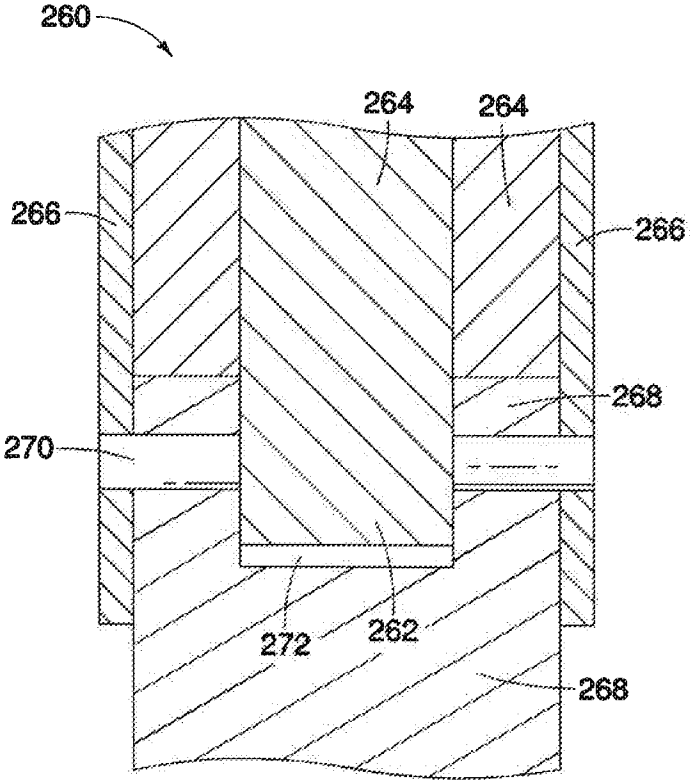
FIG. 31 is a partial sectional view of a joint for jewelry taken along sectional lines of FIG. 27 according to an embodiment of the invention.
Figure 34:
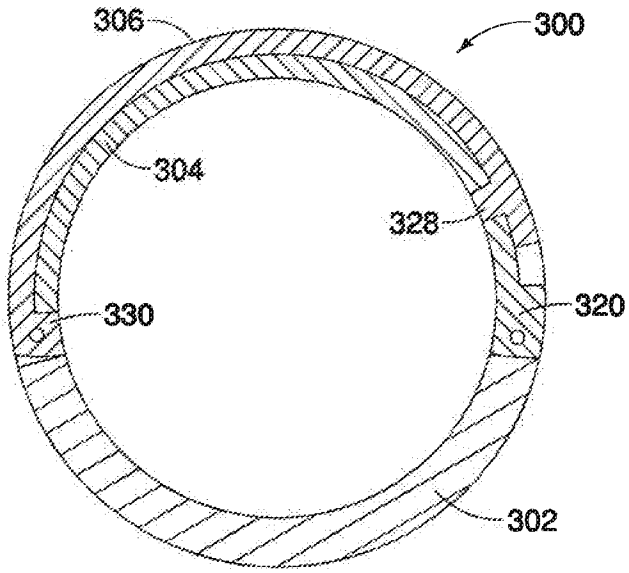
FIG. 34 is a sectional side view of the FIG. 33 jewelry in a closed orientation.

Referring to FIG. 31, an exemplary embodiment of a joint 260, appropriate for any jewelry disclosed throughout this document, is shown in a sectional view taken along sectional lines 31 in FIG. 27. In this embodiment, there is a single pivot pin that provides the pivot action for the first body, second body and a clasp. Joint 260 includes a first body 268 pivotably secured to a second body 264 via a hinge element 262 that includes a single axle or single pivot pin 270. In this embodiment, the pivot pin 270 extends through at least portions of a clasp 266 to provide the pivoting action of clasp 266 with the first body 268 and the second body 264. That is, the portions of the pivot pin 270 that are exposed from the first body 268 are received in the ears of the clasp 266 to provide the pivot action. It should be understood that the ends of pivot pin 270 may be exposed, or not, from the clasp 266. Opening 272 in the first body 268 receives the hinge element 262 of the second body 262.

Figure 32:
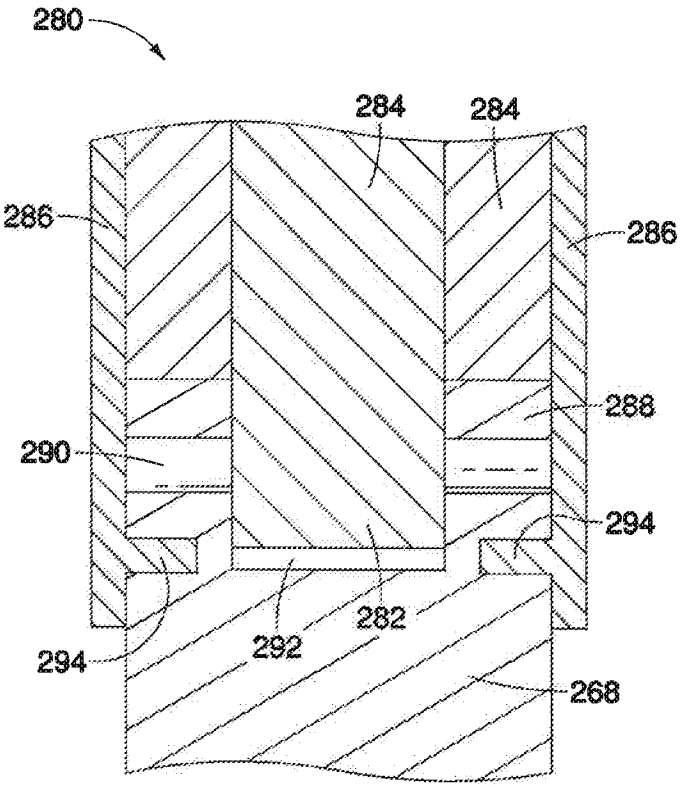
FIG. 32 is a partial sectional view of a joint for jewelry at a similar location as shown in FIG. 31 but according to another embodiment of the invention.

Referring to FIG. 32, another exemplary embodiment of a joint 280, appropriate for any jewelry disclosed throughout this document, is shown in a sectional view similar to FIG. 31. In this embodiment, there is a pair of pivot pins with one each extending inwardly from opposite interior surfaces of a clasp, and this pair of pivot pins provide the pivot action for the first body, second body and a clasp. Joint 280 includes a first body 288 pivotably secured to a second body 284 via a hinge element 282 that includes an axle or pivot pin 290. In this embodiment, the pivot pin 290 extends only through first and second bodies 268 and 282 to provide the pivoting action. Moreover, ears of a clasp 286 have independent pivot pins 294 extending inwardly to be received in openings in the first body 288 to provide the pivot action for the clasp 286. Alternatively, openings in the second body 284 can receive the independent pivot pins 294 to provide the pivot action for the clasp 286. Opening 292 in the first body 268 receives the hinge element 282 of the second body 284.

Referring to FIGS. 33-37, a fifth embodiment of jewelry 300 is illustrated. Structure of this fifth embodiment 300 that is the same as the structure in the previously described jewelry embodiments above may not be numbered nor described. Alternatively, the same structure may be numbered with the same reference number as used in the previous embodiments with, or without, further description. Still further, the same structure may be given a different reference number in this fifth embodiment 300.

Figure 33:
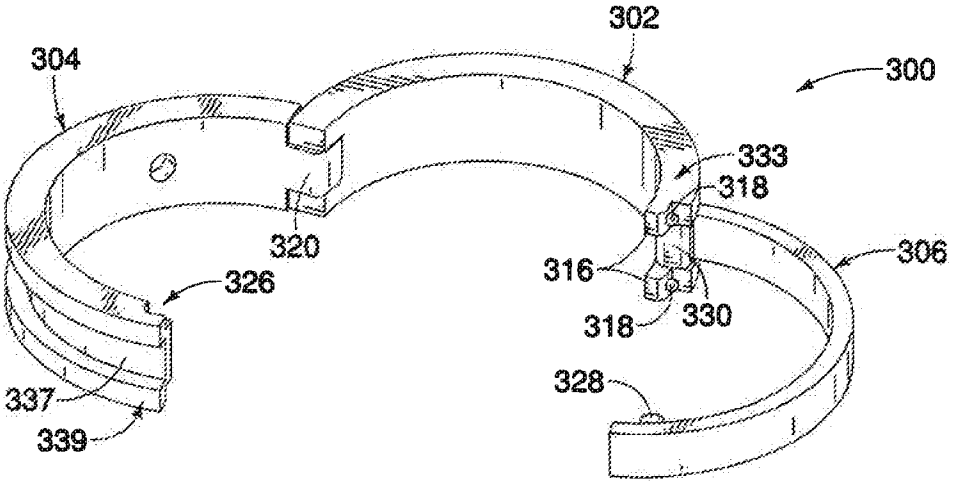
FIG. 33 is a perspective view of jewelry in an open orientation according to another embodiment of the invention.

Still referring to FIGS. 33-37, jewelry 300 includes a first body 302 pivotably secured to a second body 304 and pivotably secured to a third body 306. Referring to FIG. 33, jewelry 300 is illustrated in an exemplary open position (or orientation). An end 339 of the second body 304 has a pair of cut-away sections 326 in the lower surface located on opposite positions of the trench 337. End 333 of the first body 302 receives hinge element 330 of the third body 306. Moreover, end 333 of the first body 302 has a pair of prong projections 316 extending from a terminal face of end 333. The prong projections 316 are configured to be received in the cut-away sections 326 of the second body 304 (see FIG. 36). Nubs 318 extend upwardly from the top surfaces of each prong projection 316. Nubs 318 are configured to be received in openings in the cut-away sections 326 of the second body 304 (see FIG. 36). The pair of the prong projections 316, the nubs 318 and the openings in the pair of the cut-away sections 326 allow for the first and second bodies 302 and 304 to be locked together in the closed orientation.

Figure 35:
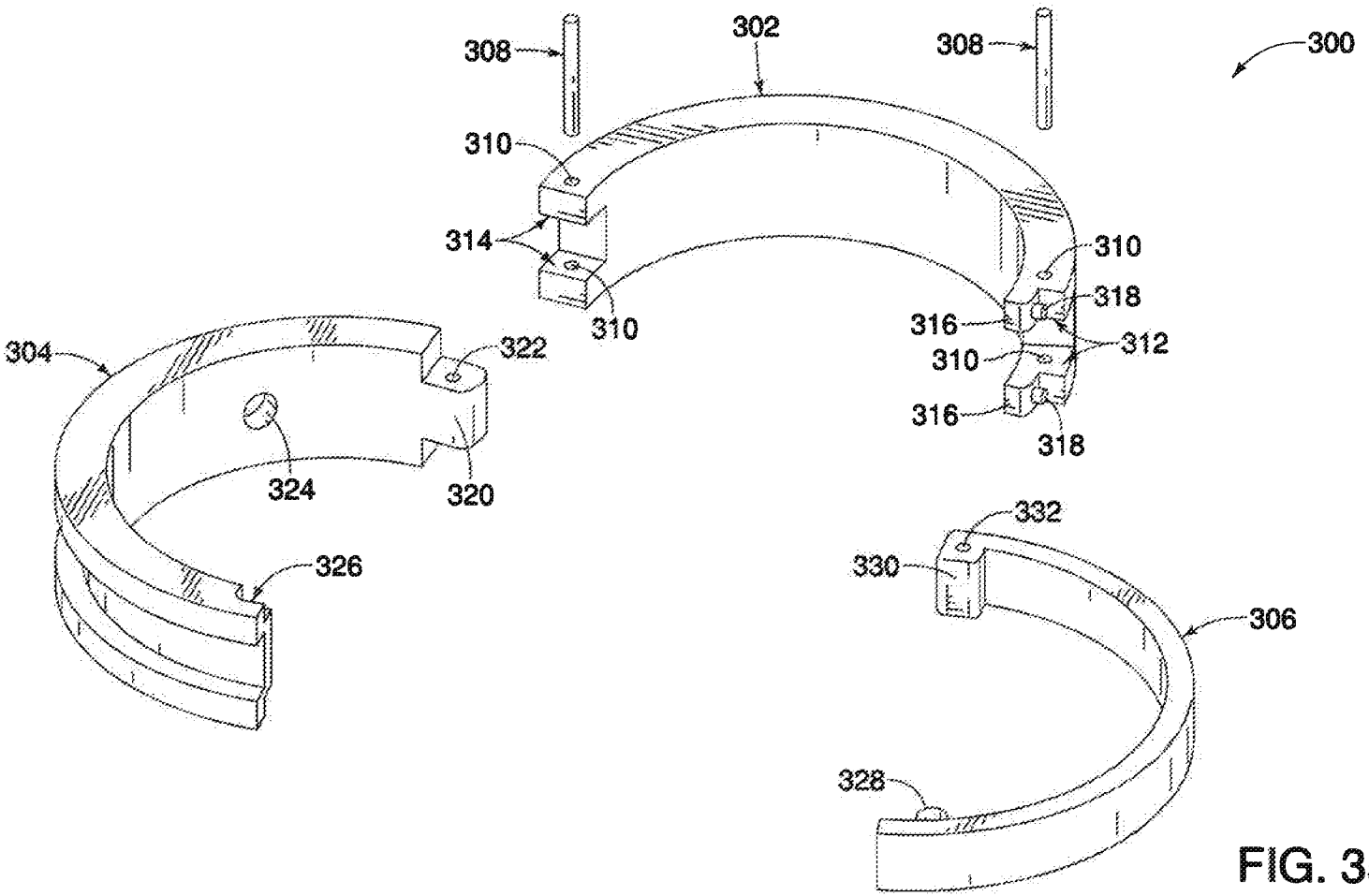
FIG. 35 is an exploded view of the FIG. 33 jewelry.
Figure 37:
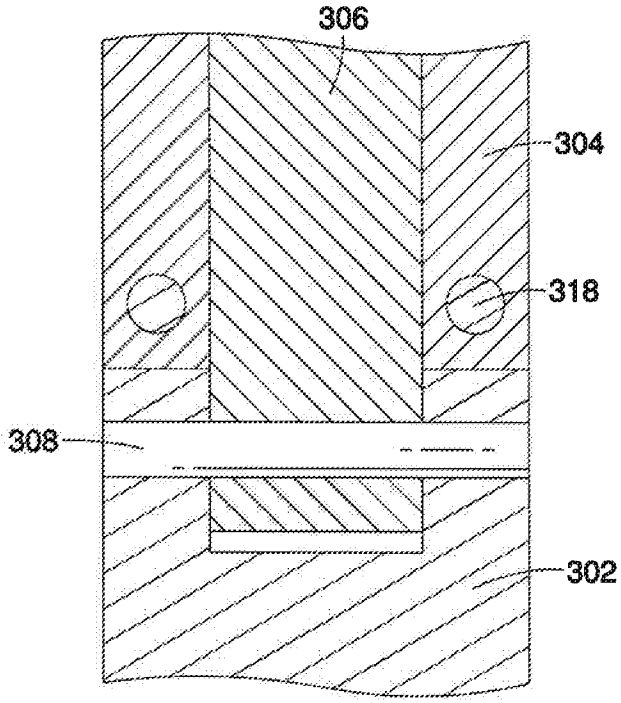
FIG. 37 is a partial front sectional view of a joint for the FIG. 33 jewelry.
Figure 36:
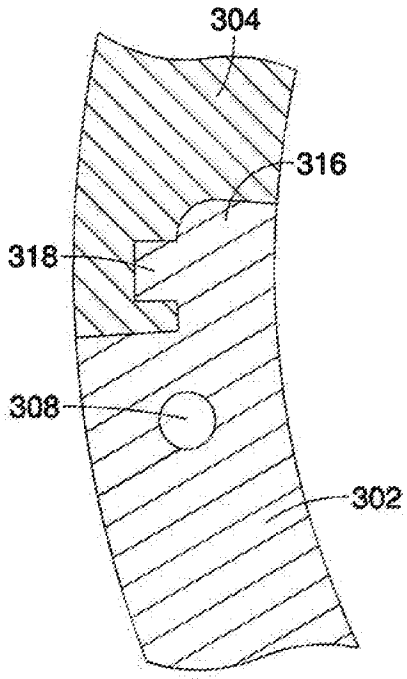
FIG. 36 is a partial side sectional view of a joint for the FIG. 33 jewelry.

Referring to FIG. 35 of jewelry 300, opposite ends of the first body 302 have openings 312 and 314, respectively, to receive hinge elements 330 and 320, respectively, of the third and second bodies 306 and 304, respectively. The end of the first body 302 with opening 314 has a pair of aligned pin openings 310 configured to be aligned with pin opening 322 in hinge element 320. Pin openings 310 and 322 receive pivot pin 308. Similarly, the end of the first body 302 with opening 312 has a pair of aligned pin openings 310 configured to be aligned with pin opening 332 in hinge element 330. Pin openings 310 and 332 receive pivot pin 308. It should be understood that any embodiment of jewelry disclosed in this document can include the combination of the pair of the prong projections, the nubs 318 and the corresponding openings in a pair of cut-away sections for locking the first and second bodies 302 and 304.

Figure 38:
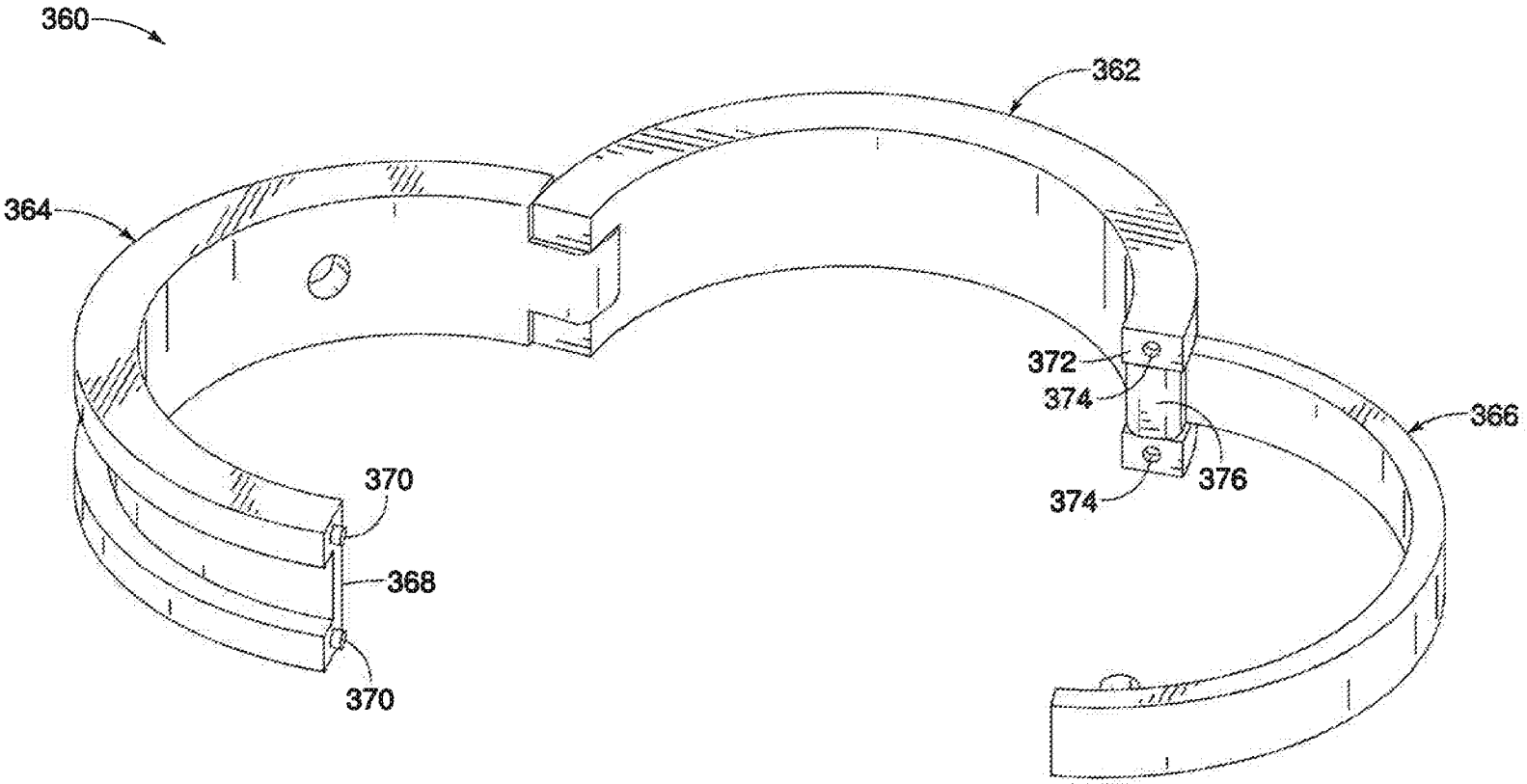
FIG. 38 is a perspective view of jewelry in an open orientation according to another embodiment of the invention.
Figure 40:
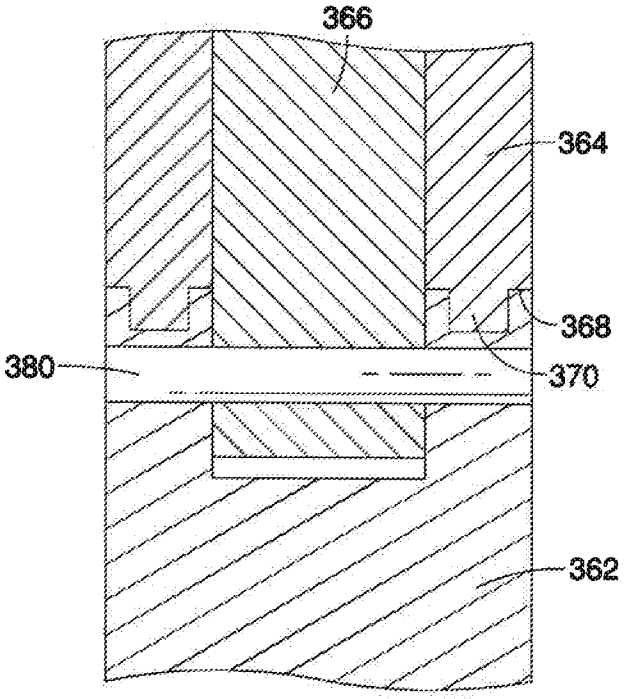
FIG. 40 is a partial front sectional view of a joint for the FIG. 38 jewelry.
Figure 39:
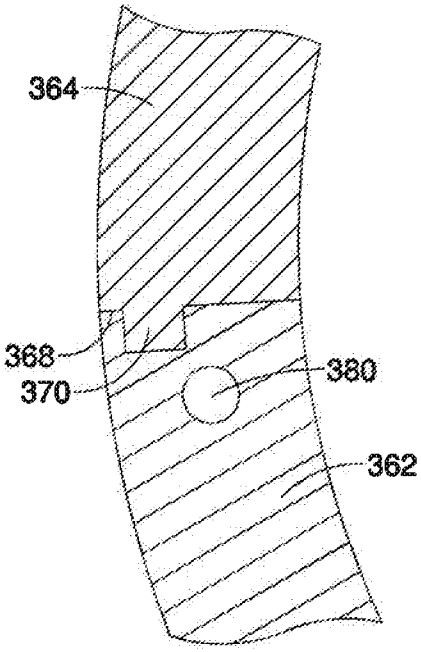
FIG. 39 is a partial side sectional view of a joint for the FIG. 38 jewelry.

Referring to FIGS. 38-40, a sixth embodiment of jewelry 360 is illustrated. Structure of this sixth embodiment 360 that is the same as the structure in the previously described jewelry embodiments above may not be numbered nor described for simplicity. Alternatively, the same structure may be numbered with the same reference number as used in the previous embodiments with, or without, further description. Still further, the same structure may be given a different reference number in this sixth embodiment 360.

Still referring to FIGS. 38-40, jewelry 360 includes a first body 362 pivotably secured to a second body 364 and pivotably secured to a third body 366. Referring to FIG. 38, jewelry 360 is illustrated in an exemplary open position (or orientation). An end of the second body 364 (which is not pivoted to the first body 362) has a terminal end face 368 with a pair of nubs 370 extending from the terminal end face 368. An end of the first body 362 receives a hinge element 376 of the third body 366 and the end has a terminal end face 372. A pair of openings 374 are defined in the terminal end face 372 and configured to receive the pair of nubs 370 of the second body 364. The nubs 370 received in the pair of openings 374 locks the first body 362 in alignment with the second body 364. It should be understood that any embodiment of jewelry disclosed in this document can include the combination of the pair of the nubs and the corresponding pair of the openings.

Figure 42:
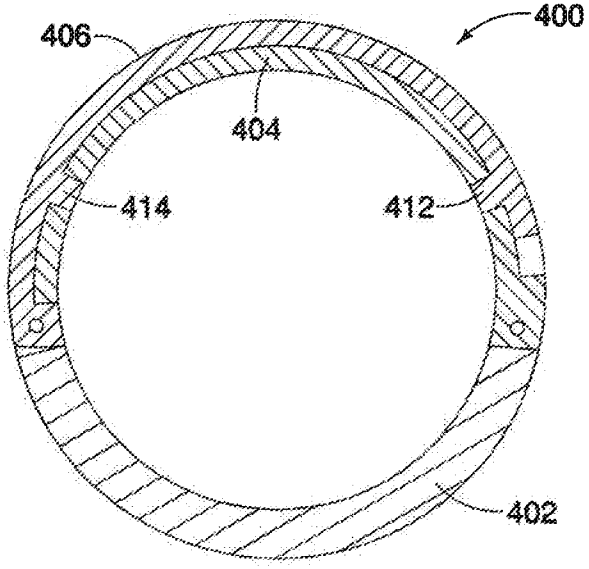
FIG. 42 is a sectional side view of the FIG. 41 jewelry in a closed orientation.
Figure 41:
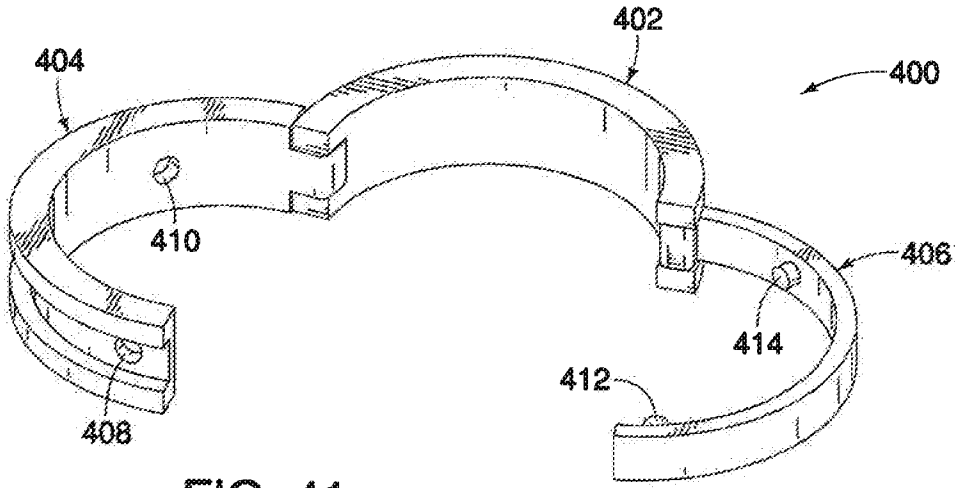
FIG. 41 is a perspective view of jewelry in an open orientation according to another embodiment of the invention.
Figure 45:
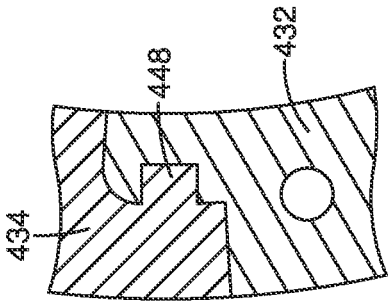
FIG. 45 is a partial side sectional view of a joint for the FIG. 43 jewelry.
Figure 44:
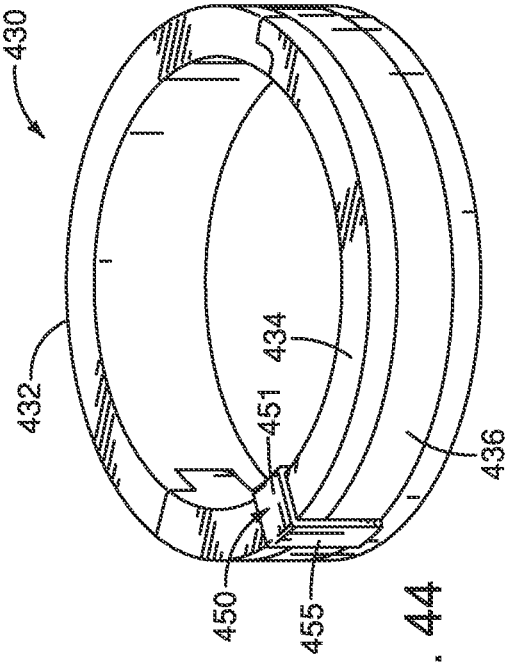
FIG. 44 is a perspective view of the FIG. 43 jewelry in a closed orientation.
Figure 43:
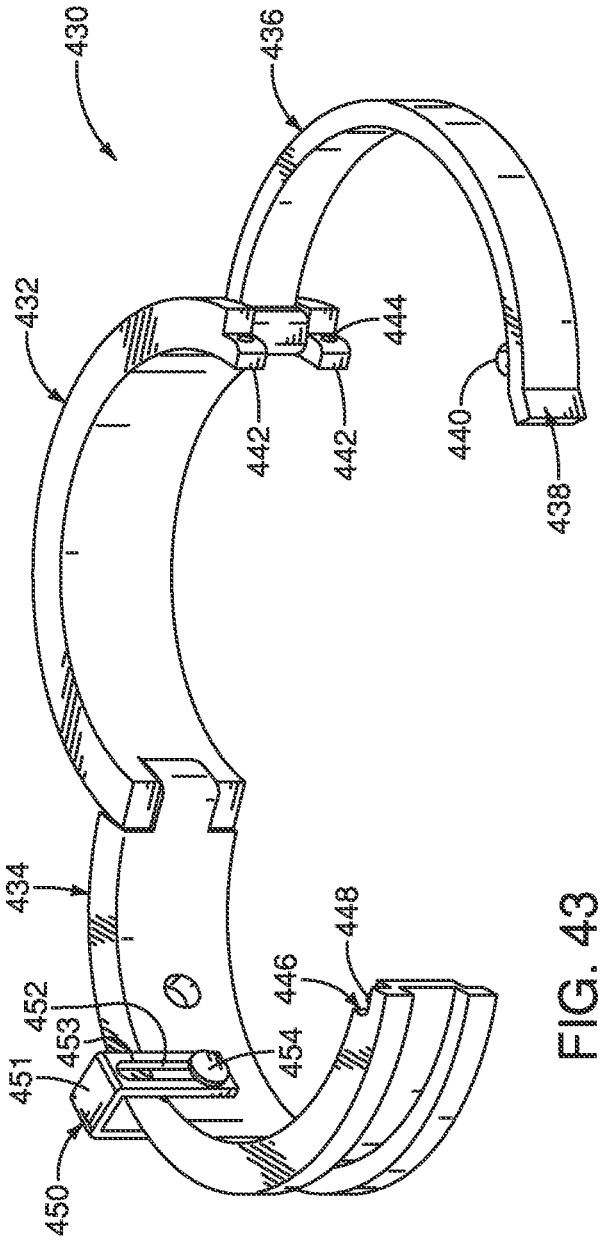
FIG. 43 is a perspective view of jewelry in an open orientation according to another embodiment of the invention.

Referring to FIGS. 41-42, a seventh embodiment of jewelry 400 is illustrated. Structure of this seventh embodiment 400 that is the same as the structure in the previously described jewelry embodiments above may not be numbered nor described for simplicity. Alternatively, the same structure may be numbered with the same reference number as used in the previous embodiments with, or without, further description. Still further, the same structure may be given a different reference number in this seventh embodiment 400.

Still referring to FIGS. 41-42, jewelry 400 includes a first body 402 pivotably secured to a second body 404 and pivotably secured to a third body 406. A bottom surface of the third body 406 has a pair of spaced projections 412 and 414. The second body 404 has a pair of openings 408 and 410 configured to receive projections 414 and 412, respectively. It should be understood that any embodiment of jewelry disclosed in this document can include the combination of the pair of the projections and the corresponding pair of openings to receive the projections. Alternatively, any embodiment of jewelry disclosed in this document can include the combination of three or more of the projections and corresponding three or more openings to receive the projections.

Referring to FIGS. 43-48, an eighth embodiment of jewelry 430 is illustrated. Structure of this eighth embodiment 430 that is the same as the structure in the previously described jewelry embodiments above may not be numbered nor described for simplicity. Alternatively, the same structure may be numbered with the same reference number as used in the previous embodiments with, or without, further description. Still further, the same structure may be given a different reference number in this eighth embodiment 430.

Still referring to FIGS. 43-48, jewelry 430 includes a first body 432 pivotably secured to a second body 434 and pivotably secured to a third body 436. The third body 436 has a terminal end 438 that angles upwardly from the curvature of the rest of the third body 436. This terminal end 438 can be thought of as another embodiment of a tab, or finger tab 436 to enhance finger engagement. It should be understood that any embodiment of jewelry disclosed in this document can include the finger tab that angles upwardly from the curvature of the rest of the third body to facilitate finger engagement of the third body.

Jewelry 430 is illustrated in an exemplary open position (or orientation). An end of the second body 434 has a pair of cut-away sections 446 and an end of the first body has a pair of prong projections 442 similar to the fifth embodiment of jewelry 300. The pair of prong projections 442 of this eighth embodiment are configured to be received in the cut-away sections 446 same as the fifth embodiment; however, the pair of nubs 448 and openings 444 to receive the nubs 448 of this eighth embodiment are reversed relative to the fifth embodiment. That is, the pair of nubs 448 are in the cut-away sections 446 of the second body 434 and the corresponding pair of openings 444 are in the pair of prong projections 442.

Still referring to FIGS. 43-48, jewelry 430 includes a slide clamp 450 in sliding engagement with the second body 434. A slide pin 454 is affixed in a stationary fashion to, and extends through or is secured in, a portion of a lower surface of the second body 434 (alternatively, the slide pin 454 can be designed to be an integral structure of the second body 434). The slide clamp 450 has a lower linear portion 453 that extends along and adjacent the lower surface of the second body 434 and an upper linear portion 455 that extends along and adjacent the upper surface of the second body 434. The slide clamp 450 has a back (or side) portion 451 that connects and maintains the lower and upper linear portions 453 and 455 in a spaced and parallel relationship. Corresponding edges of the upper and lower linear portions 455 and 453 are connected by the back portion 451 wherein the upper and lower linear portions 455 and 453 extend perpendicularly from the back portion 451. The lower linear portion 453 of the slide clamp 450 defines a longitudinal, linear opening 452 configured to slidingly engage a stem of slide pin 454 at the lower surface of the second body 434 wherein a head portion of the slide pin 454 secures the slide clamp 450 to the second body 434.

Figure 47:
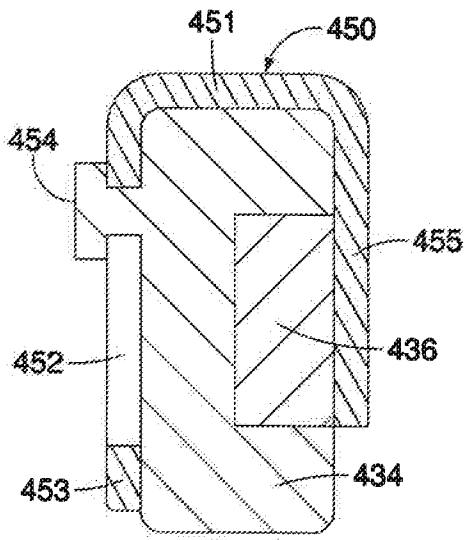
FIG. 47 is a sectional view of a clamp according to an embodiment of the invention in a closed orientation for the FIG. 43 jewelry.
Figure 46:
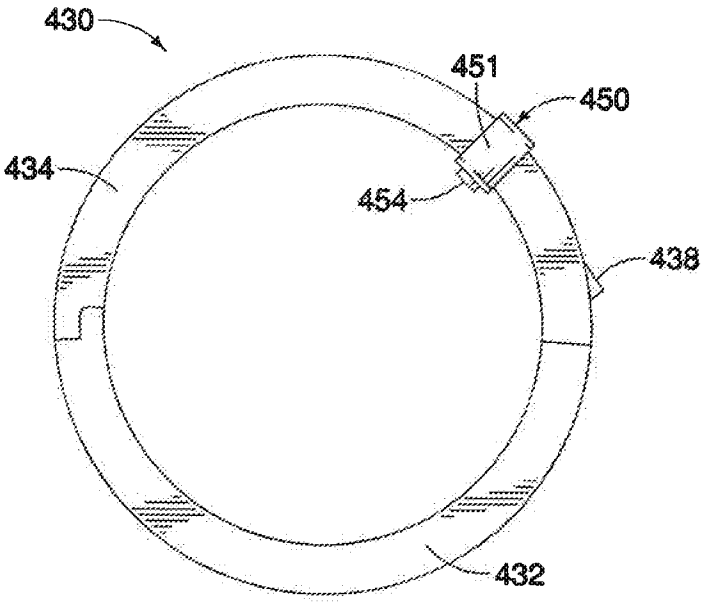
FIG. 46 is a side view of the FIG. 43 jewelry.
Figure 49:
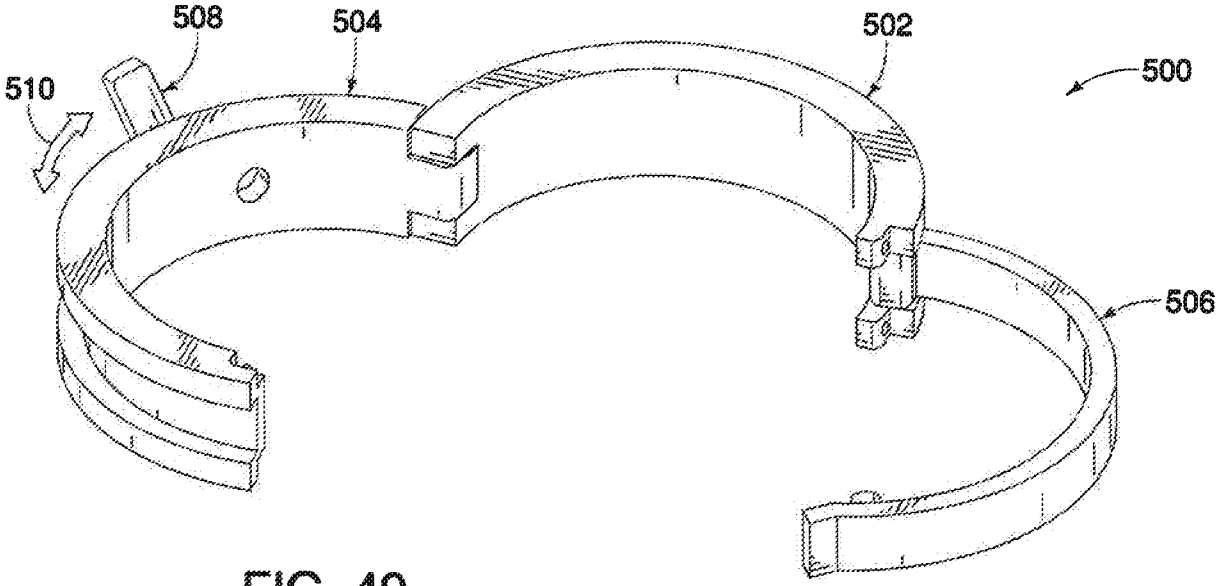
FIG. 49 is a perspective view of jewelry in an open orientation according to another embodiment of the invention.
Figure 50:
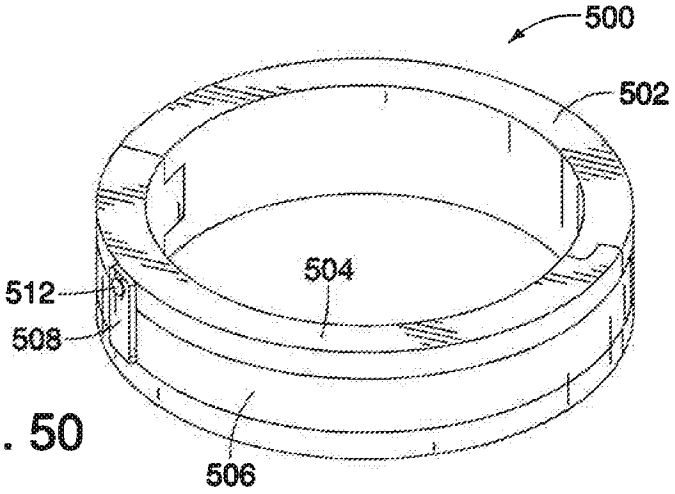
FIG. 50 is a perspective view of the FIG. 49 jewelry in a closed orientation.

Referring to FIG. 47, the slide clamp 450 is shown in the closed orientation wherein the upper linear portion 455 is received over, and locks in, the third body 436 in the trench of the second body 434. In this orientation, the slide pin 454 is at one end of the linear opening 452 of the slide clamp 450. It should be understood that the slide clamp 450 can be designed to have the lower linear portion 453 and slide pin 454 recessed into the second body 434.

Figure 48:
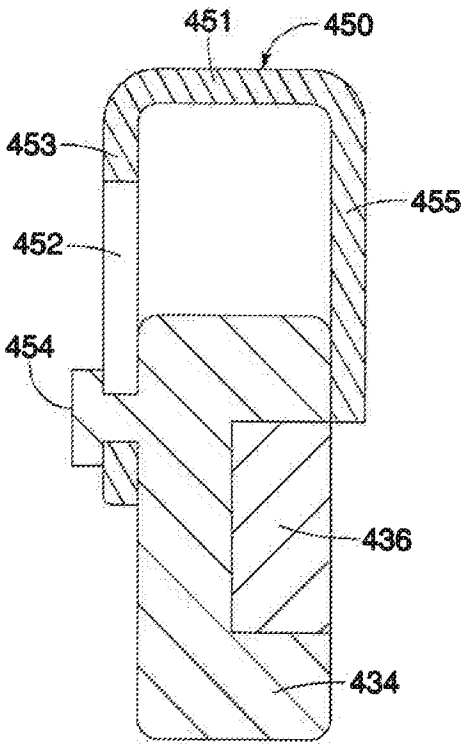
FIG. 48 is a sectional view of the FIG. 47 clamp in an open orientation for the FIG. 43 jewelry.

Referring to FIG. 48, the slide clamp 450 is shown in the open orientation wherein the upper linear portion 455 is removed from being over the third body 436, and therefore, unlocks the third body 436 from the trench of the second body 434. In this orientation, the slide pin 454 is at an opposite end of the linear opening 452 of the slide clamp 450 relative the closed orientation. That is, the slide clamp 450 moves, or slides, linearly along the width dimensions of the second and third bodies 434 and 436 alternatively between the closed and open orientations. In the closed orientation, the back portion 451 is adjacent or against a side of the second body 434 and the slide pin 454 is at one end of the linear opening 452. In the open orientation, the back portion 451 is spaced from the side of the second body 434 and the slide pin 454 is at an opposite end of the linear opening 452. In this open orientation, the upper linear portion 455 does not impede the third body 436. It should be understood that any embodiment of jewelry disclosed in this document can include the slide clamp.

Referring to FIGS. 49-53, a ninth embodiment of jewelry 500 is illustrated. Structure of this ninth embodiment 500 that is the same as the structure in the previously described jewelry embodiments above may not be numbered nor described for simplicity. Alternatively, the same structure may be numbered with the same reference number as used in the previous embodiments with, or without, further description. Still further, the same structure may be given a different reference number in this ninth embodiment 500.

Figure 53:
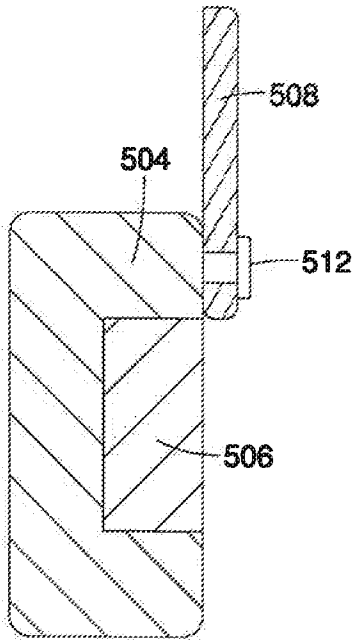
FIG. 53 is a sectional view of the FIG. 52 clamp in an open orientation for the FIG. 49 jewelry.
Figure 52:
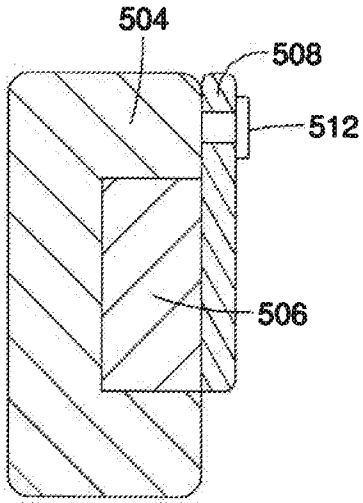
FIG. 52 is a sectional view of a clamp according to an embodiment of the invention in a closed orientation for the FIG. 49 jewelry.
Figure 51:
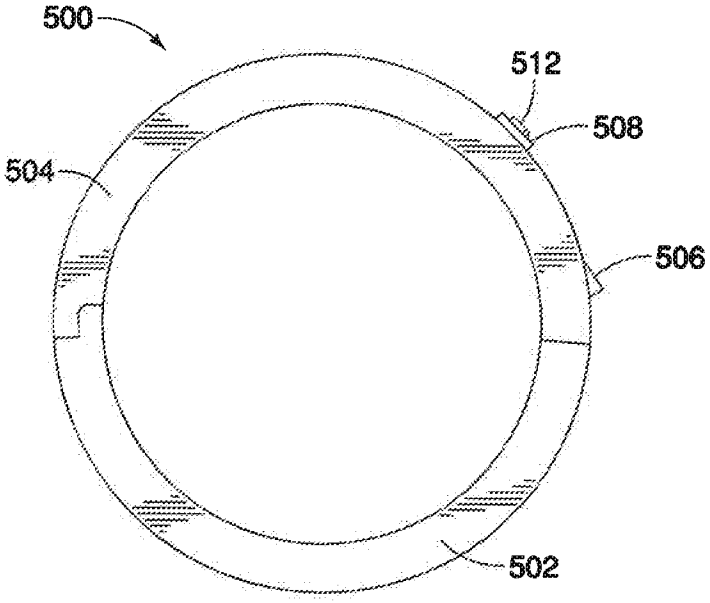
FIG. 51 is a side view of the FIG. 49 jewelry.

Still referring to FIGS. 49-53, jewelry 500 includes a first body 502 pivotably secured to a second body 504 and pivotably secured to a third body 506. Jewelry 500 includes a rotation clamp 508 in rotating engagement with a pivot pin 512 over the second and third bodies 504 and 506. The pivot pin 512 is affixed in a stationary fashion to, and extends through or secured in, an upper surface of the second body 504. Alternatively, the rotation clamp 508 and the pivot pin 512 can be recessed in the second and third bodies 504 and 506. The rotation clamp 508 is a simple linear structure that rotates in selective back and forth directions 510 (see FIG. 49). Referring to FIG. 52, the rotation clamp 508 is shown in the closed orientation wherein the rotation clamp 508 is received over, and locks in, the third body 506 in the trench of the second body 504. Referring to FIG. 53, the rotation clamp 508 is shown in the open orientation wherein the rotation clamp 508 is rotated on pivot pin 512 from being over, and unlocking, the third body 506 from the trench of the second body 504. It should be understood that any embodiment of jewelry disclosed in this document can include the rotation clamp.

Figure 54:
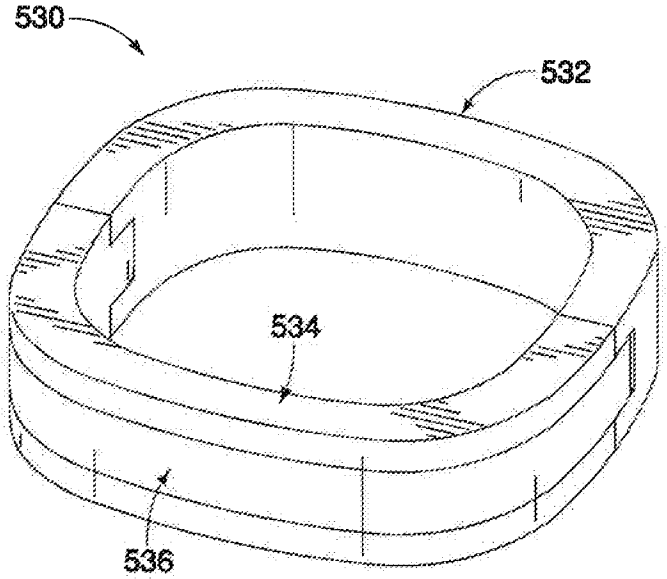
FIG. 54 is a perspective view of jewelry in a closed orientation according to another embodiment of the invention.

Referring to FIG. 54, a tenth embodiment of jewelry 530 is illustrated. Jewelry 530 includes a first body 532 pivotably secured to a second body 534 and pivotably secured to a third body 536. Jewelry 530 is shown in a closed orientation. In this embodiment, the inner periphery of jewelry 530 is not circular but more of a square configuration with rounded corners. Moreover, the outer periphery of jewelry 530 is not circular but more of a square configuration with rounded corners. Furthermore, the inner periphery of jewelry 530 conforms and corresponds with the outer periphery. It should be understood that any embodiment of jewelry disclosed in this document can have the combination of the inner and outer peripheries with rounded corners. It should be understood that this inner periphery configuration facilitates maintaining jewelry 530 in a selected position on the body.

Figure 55:
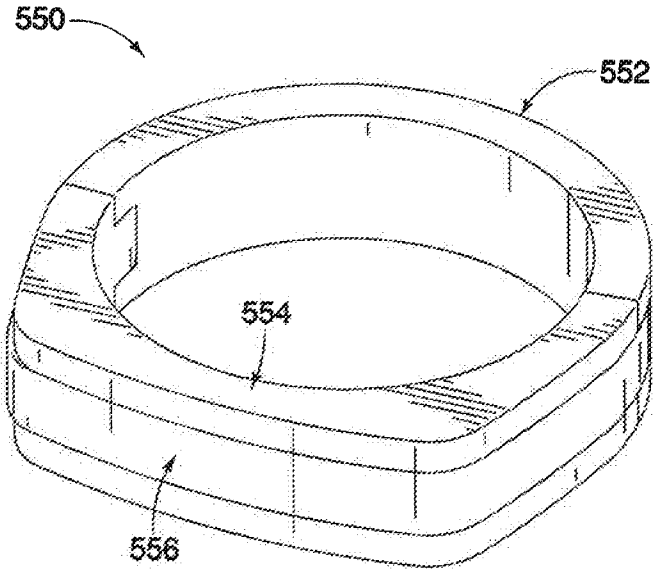
FIG. 55 is a perspective view of jewelry in a closed orientation according to another embodiment of the invention.

Referring to FIG. 55, an eleventh embodiment of jewelry 550 is illustrated. Jewelry 550 includes a first body 552 pivotably secured to a second body 554 and pivotably secured to a third body 556. Jewelry 550 is shown in a closed orientation. In this embodiment, the inner periphery of jewelry 550 is circular which includes the inner peripheries of the first and second bodies 552 and 554. The outer periphery of the first body 552 is not circular. The outer periphery of the second and third bodies 554 and 556 has rounded corners. Accordingly, only one of the inner and outer peripheries is circular. Alternatively, at least one of the inner and outer peripheries is not circular. In another embodiment not shown, the inner periphery of the jewelry is not circular while the outer periphery is circular. It should be understood that any embodiment of jewelry disclosed in this document can have the combination of the inner and outer peripheries described in this paragraph.

Figure 56:
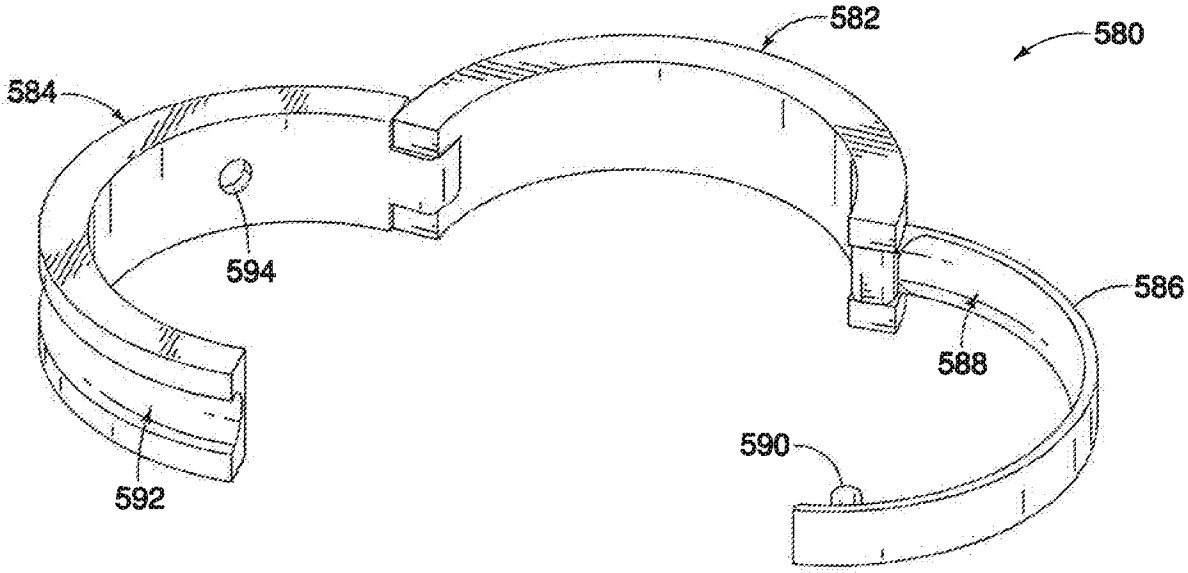
FIG. 56 is a perspective view of jewelry in an open orientation according to another embodiment of the invention.
Figure 57:
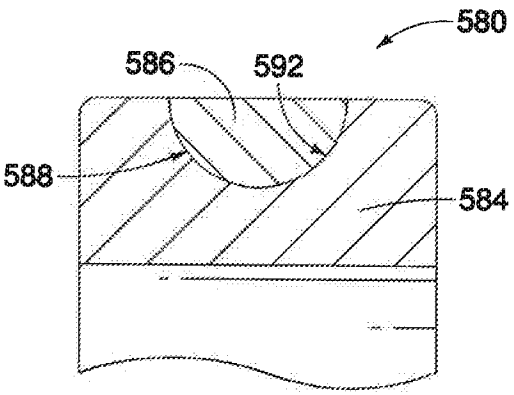
FIG. 57 is a sectional view along a thickness direction of the FIG. 56 jewelry in a closed orientation.

Referring to FIGS. 56-57, a twelfth embodiment of jewelry 580 is illustrated. Jewelry 580 includes a first body 582 pivotably secured to a second body 584 and pivotably secured to a third body 586. Jewelry 580 is shown in an open orientation in FIG. 56. In this embodiment, trench 592 of the second body 584 has a curved configuration. A bottom surface 588 of the third body 586 has a corresponding curved configuration to fit snugly in trench 592 of the second body 584. This configuration of the second and third bodies 584 and 586 facilitates aligning the placement of the third body 586 into the trench 592 of the second body 584. Moreover, this curved configuration of the second and third bodies 584 and 586 facilitates maintaining jewelry 580 in a closed orientation. Projection 590 fits in opening 594 when jewelry 580 is in the closed orientation. It should be understood that any embodiment of jewelry disclosed in this document can have the curved configurations of the second and third bodies disclosed by this twelfth embodiment.

Figure 58:
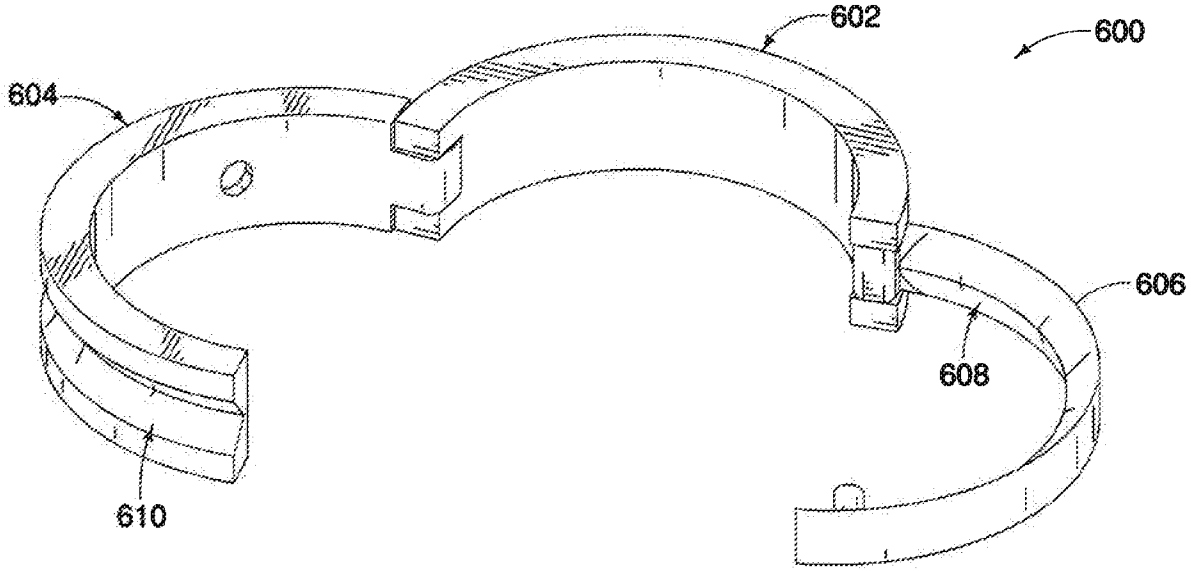
FIG. 58 is a perspective view of jewelry in an open orientation according to another embodiment of the invention.
Figure 59:
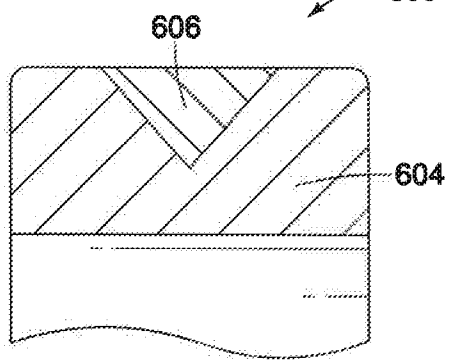
FIG. 59 is a sectional view along a thickness direction of the FIG. 58 jewelry in a closed orientation.

Referring to FIGS. 58-59, a thirteenth embodiment of jewelry 600 is illustrated. Jewelry 600 includes a first body 602 pivotably secured to a second body 604 and pivotably secured to a third body 606. Jewelry 600 is shown in an open orientation in FIG. 58. In this embodiment, trench 610 of the second body 604 has a V-shaped configuration. A bottom surface 608 of the third body 606 has a corresponding V-shaped configuration to fit snugly in trench 610 of the second body 604. This configuration of the second and third bodies 604 and 606 facilitates aligning the placement of the third body 606 into the trench 610 of the second body 604. Moreover, this V-shaped configuration of the second and third bodies 604 and 606 facilitates maintaining jewelry 600 in a closed orientation. It should be understood that any embodiment of jewelry disclosed in this document can have the V-shaped configurations of the second and third bodies disclosed by this thirteenth embodiment.

Figure 60:
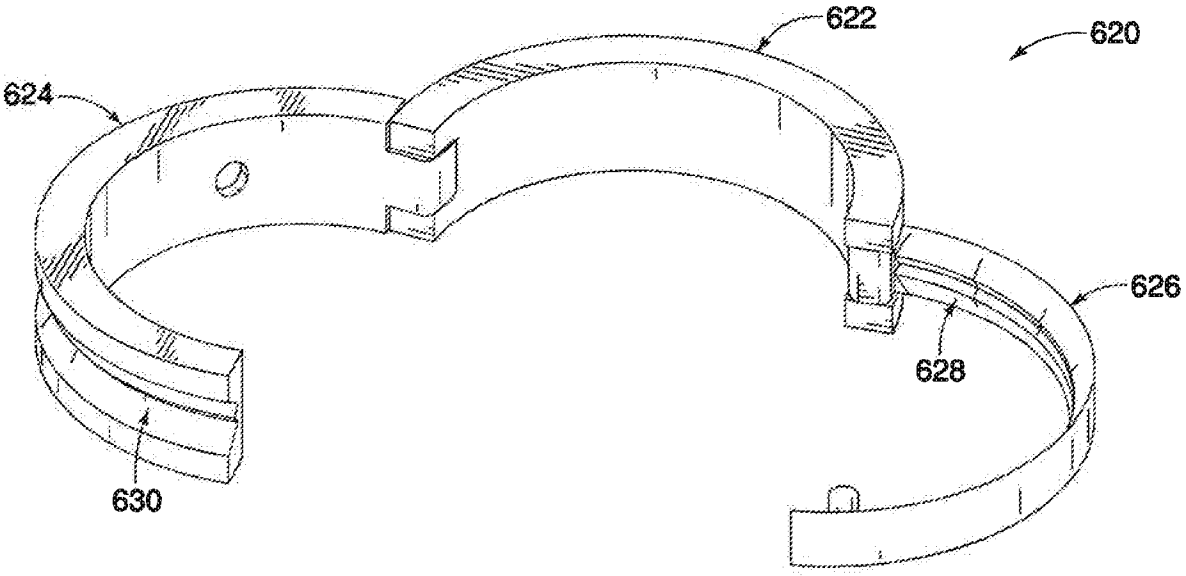
FIG. 60 is a perspective view of jewelry in an open orientation according to another embodiment of the invention.
Figure 61:
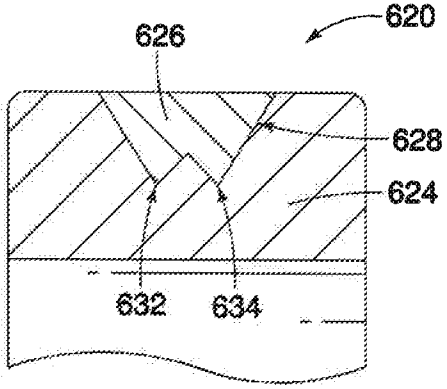
FIG. 61 is a sectional view along a thickness direction of the FIG. 60 jewelry in a closed orientation.

Referring to FIGS. 60-61, a fourteenth embodiment of jewelry 620 is illustrated. Jewelry 620 includes a first body 622 pivotably secured to a second body 624 and pivotably secured to a third body 626. Jewelry 620 is shown in an open orientation in FIG. 60. In this embodiment, trench 630 of the second body 624 has a W-shaped configuration. A bottom surface 628 of the third body 626 has a corresponding W-shaped configuration to fit snugly in trench 630 of the second body 624 (two bottommost points 632 and 634 shown in FIG. 61). This configuration of the second and third bodies 624 and 626 facilitates aligning the placement of the third body 626 into the trench 630 of the second body 624. Moreover, this W-shaped configuration of the second and third bodies 624 and 626 facilitates maintaining jewelry 620 in a closed orientation. It should be understood that any embodiment of jewelry disclosed in this document can have the W-shaped configurations of the second and third bodies disclosed by this fourteenth embodiment.

Figure 64:
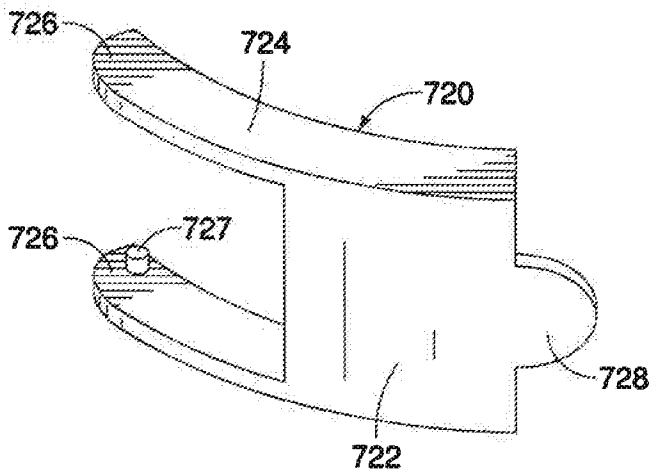
FIG. 64 is a perspective view of an exemplary clasp for jewelry according to another embodiment of the invention.
Figure 63:
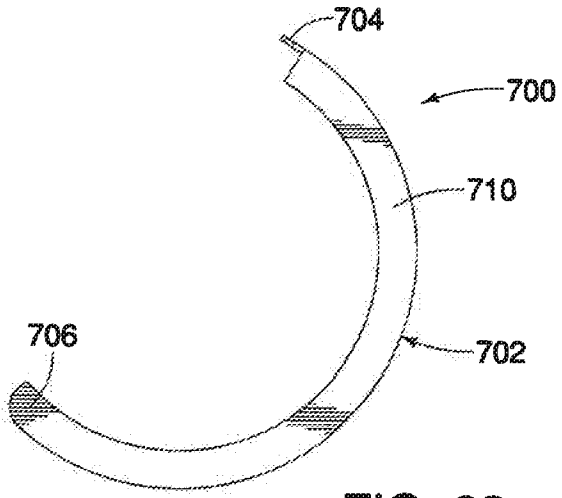
FIG. 63 is a side view of the clasp of FIG. 62.
Figure 62:
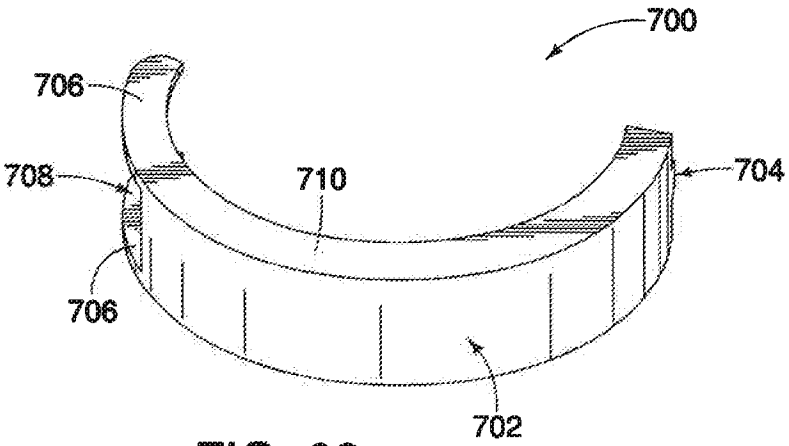
FIG. 62 is a perspective view of an exemplary clasp for jewelry according to an embodiment of the invention.

Referring to FIGS. 62-64, two additional embodiments of clasps for the jewelry disclosed in this document are illustrated and described. Referring to FIGS. 62-63, clasp 700 is an arcuate structure and includes two spaced and parallel sides 710 connected by an upper surface 702. In the rear section of clasp 700 are two spaced and parallel ears 706 with a space 708 therebetween. Ears 706 can fit over the sides of one or more bodies of the jewelry disclosed throughout this document and provide the pivoting action with the jewelry. The opposite end of clasp 700 from the ears 706 is the front end (front edge) which includes tab (finger tab) 704 extending from the upper surface 702 (and front edge) that can be used to facilitate finger engagement.

Referring to FIG. 64, clasp 720 is an arcuate structure and includes two spaced and parallel sides 724 connected by an upper surface 722. In the rear section of clasp 720 are two spaced and parallel ears 726 with a space therebetween. Extending from an inner surface of ears 726 are pivot nubs 727 that will provide the pivoting action with the jewelry disclosed throughout this document. The opposite the end of clasp 720 from the ears 726 is the front end (front edge) of clasp 720 which includes tab (or finger tab) 728 extending from the upper surface 722 (and front edge) that can be used to facilitate finger engagement.

It should be understood that the embodiments disclosed throughout this document do not have to include the opening in the second body configured to receive the projection. Moreover, it should be understood that the embodiments disclosed in this document that have the opening to receive the projection in the second body do not need to have the opening provided to extend through an entirety of the structure of the second body. That is, the opening can extend only partially through the second body. Still further, a projection and corresponding opening can be provided in different locations of the jewelry than specifically disclosed by the exemplary embodiments in this document.

It should be further understood that the embodiments of the jewelry disclosed in this document wherein the trenches of the second bodies can be configured differently than shown herein with the bottommost surfaces of the third bodies configured to correspond to the trenches.

It should be understood that for any embodiment of jewelry disclosed in this document can include any of the following: a gem (or jewel), or any combinations of gems, secured to one or more of the first, second, third bodies and clasp (clamp). It should be understood that gems include synthetic gems.

It should be understood that the jewelry embodiments disclosed throughout this document are efficient and durable solutions that enable people with enlarged knuckles to wear jewelry, such as rings, with security and comfort.

The embodiments of inventive jewelry disclosed throughout this document are an efficient, durable solution for enabling people with enlarged knuckles to wear the jewelry, for example, rings with security and comfort. Still further, the inventive designs lock the jewelry in place on the person's selected body part ensuring the jewelry will remain with the person and not unlock to fall off the person and be lost. The embodiments of jewelry are versatile assemblies of material and mechanism design made of two or more moving parts. With two arms (second and third bodies) pivotably secured (via hinges or hinge elements) to opposite ends of the base arm (first body) wherein half of the jewelry is able to open fully and therefore accommodate any size of knuckle. One of more of the third body (locking arm), clasp and clamp will lock the jewelry into place for a secure and permanent fit.

The functional aspects of the embodiments of inventive jewelry are discreet and do not distract from the overall design as jewelry. All sides of the designs are smooth and all components fit flush without latches or hinges to snag clothing or irritate a person's body. All embodiments can be tapered for a comfort fit or altered during installation with an off-set shank. The designs of the inventive jewelry will impede and diminish wear and tear to the jewelry so, as an example only, a ring can be made to fit well and remain properly oriented in the upright position.

It should be understood that all clamp structures disclosed in this document can be designed to be recessed in one or more of the first, second and third body components to have a completely flush and smooth jewelry structure. It should be understood that all clasp structures disclosed in this document can be designed to be recessed in one or more of the first, second and third body components to have a completely flush and smooth jewelry structure.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A finger ring comprising:

an arcuate first body comprising opposite first and second ends;

an arcuate second body pivotably secured to the first end of the first body;

an arcuate third body pivotably secured to the second end of the first body;

and a slide clamp comprising a back portion that connects and maintains a lower linear portion in a spaced and parallel relation with an upper linear portion, the slide clamp is figured to slide into a closed orientation wherein the slide clamp slides perpendicularly to a width dimension of the arcuate second body and slides perpendicularly to a width dimension of the arcuate third body and locks the arcuate third body in a trench in the arcuate second body.

2. The finger ring of claim 1 wherein the second end of the arcuate first body comprises a terminal end having a pair of prong projections laterally spaced from each other and configured to be received in a pair of corresponding cut-away sections defined in an end of the arcuate second body opposite to an end of the arcuate second body pivotably secured to the first end of the arcuate first body.

3. The finger ring of claim 2 wherein each prong projection has an opening to receive a corresponding nub extending from a surface of each cut-away section.

4. The finger ring of claim 1 wherein the arcuate third body comprises a terminal end that angles upwardly from the curvature of the arcuate third body.

5. The finger ring of claim 4 wherein the terminal end that angles upwardly comprises a finger tab.

6. The finger ring of claim 5 wherein the finger tab comprises a planar structure extending at an angle from the curved structure of the arcuate third body.

7. The finger ring of claim 1 wherein the lower linear portion defines a longitudinal, linear opening configured to sliding engage a stem of a slide pin extending from a lower surface of the arcuate second body.

8. The finger ring of claim 7 wherein, in the closed orientation, the slide pin is at one end of the longitudinal, linear opening in the lower linear portion of the slide clamp.

9. The finger ring of claim 1 wherein, in the closed orientation, the back portion of the slide clamp is against a side of the arcuate second body.

10. The finger ring of claim 1 wherein, in the closed orientation, the upper linear portion of the slide clamp covers an entirety of thickness of the arcuate third body.

11. The finger ring of claim 1 wherein, in an open orientation, the back portion of the slide clamp is spaced from a side of the arcuate second body.

12. The finger ring of claim 7 wherein, in the open orientation, the slide pin is at an opposite end of the longitudinal, linear opening relative to the one end in the lower linear portion of the slide clamp.

13. The finger ring of claim 1 wherein, in the closed orientation, the upper linear portion of the slide clamp is against an upper surface of the arcuate second body and against an upper surface of the arcuate third body.

14. The finger ring of claim 1 wherein the lower linear portion of the slide clamp terminates at a greater distance from the back portion than the upper linear portion.

15. The finger ring of claim 1 wherein the lower linear portion of the slide clamp has a greater length dimension than the upper linear portion.

* * * * *